US006817968B2

(12) United States Patent
Galbraith et al.

(10) Patent No.: US 6,817,968 B2
(45) Date of Patent: Nov. 16, 2004

(54) EXERCISE MACHINE FOR PERFORMING ROWING-TYPE AND OTHER EXERCISES

(76) Inventors: Scott Galbraith, 2960 Naomi Dr., North Logan, UT (US) 84341; Roger Dahle, 745 Canyon Rd., Providence, UT (US) 84332

( * ) Notice: Subject to any disclaimer, the term of this patent is extended or adjusted under 35 U.S.C. 154(b) by 322 days.

(21) Appl. No.: 10/192,484

(22) Filed: Jul. 9, 2002

(65) Prior Publication Data

US 2004/0009849 A1 Jan. 15, 2004

(51) Int. Cl.[7] ..... A63B 69/06; A63B 21/02
(52) U.S. Cl. ..... 482/72; 482/121
(58) Field of Search ..... 482/72, 95–96, 482/114–116, 121–126, 135–136, 142

(56) References Cited

U.S. PATENT DOCUMENTS 2,714,507 A * 8/1955 Goodrich ..... 482/72
4,421,307 A * 12/1983 Cunnington et al. ..... 482/72
4,921,242 A * 5/1990 Watterson ..... 482/72
5,072,929 A * 12/1991 Peterson et al. ..... 482/72
5,529,557 A * 6/1996 Barton ..... 482/95
5,547,444 A * 8/1996 Huang ..... 482/72
5,591,108 A * 1/1997 Chen ..... 482/95
5,626,542 A * 5/1997 Dalebout et al. ..... 482/96
5,672,142 A * 9/1997 Wu ..... 482/96
5,827,158 A * 10/1998 Drecksel ..... 482/96
5,913,752 A * 6/1999 Bolf ..... 482/72
6,634,996 B2 * 10/2003 Jacobsen ..... 482/96

* cited by examiner

*Primary Examiner*—Nicholas D. Lucchesi
*Assistant Examiner*—Fenn C. Mathew
(74) *Attorney, Agent, or Firm*—Holme Roberts & Owen LLP

(57) ABSTRACT

An exercise machine includes a longitudinal rail for slidably supporting a carriage assembly together with the weight of a user. The longitudinal rail is supported at an elevation above a support surface by a fore support structure positioned at the fore end of the rail and by an aft support structure positioned at the aft end of the rail. A carriage assembly slidably engages the rail structure and supports the weight of a user on the rail structure. The carriage assembly includes roller wheels for rolling engagement with the rail. A lever is pivotally connected to the rail and enables a user to operate the exercise machine. The lever has a hand grip assembly at one end and a foot grip assembly at the other end. A resistance structure is connected to and positioned between the fore end of the rail and the carriage assembly and provides resistance to translational movement of the carriage assembly and pivotal movement of the lever. A cable connects the lever to the carriage assembly and, thereby, to the resistance structure. A pulley is secured to the aft end of the rail and is used to guide the ends of the cable to the lever and to the carriage. A seat is positioned on the carriage for sitting by a user, who operates the exercise machine in a conventional or modified rowing-type fashion.

20 Claims, 23 Drawing Sheets

EXERCISE MACHINE FOR PERFORMING ROWING-TYPE AND OTHER EXERCISES

BACKGROUND OF THE INVENTION

1. Field of the Invention

The present invention relates to exercise machines and, more particularly, to rowing-type exercise machines having a carriage assembly slidably disposed on a longitudinal rail and operably connected both to a resistance means and to a pivoting hand and foot lever assembly.

2. State of the Art

Rowing-type exercise machines are used to duplicate the rowing motions and the associated resistance to rowing motions that a user might be expected to experience while rowing. One style of rowing-type exercise machine, for example, duplicates the motion and resistance of oars moving through water through use of a structure having a pair of arms that are pivotally connected to a frame and a resistance structure that is operably connected between the arms and the frame. The user duplicates the rowing motion by sitting on a seat that is also connected to the frame and pulling the pair of arms toward his or her body in a repeating, cyclical fashion. Examples of this type of rowing machine may be found in U.S. Pat. No. 432,598 (Bryon), U.S. Pat. No. 1,217,292 (Firth), U.S. Pat. No. 4,563,000 (Gall) and U.S. Pat. No. 5,441,469 (Chern). Other styles of rowing-type exercise machines, wherein the user duplicates the rowing motion by means other than a pair of pivotally connected arms, are disclosed in U.S. Pat. No. 4,880,224 (Jonas et al.), U.S. Pat. No. 5,013,033 (Watterson et al.), U.S. Pat. No. 5,370,593 (Wang), U.S. Pat. No. 5,512,027 (Chen) and U.S. Pat. No. 5,582,563 (Fan).

SUMMARY OF THE INVENTION

An exercise machine includes at least one longitudinal rail having a fore end and an aft end spaced from the fore end. A support structure is connected to the at least one longitudinal rail and serves to elevate the longitudinal rail above a support surface, and in a stable fashion so that the exercise machine will not tip over during use. A lever structure is pivotally connected to the at least one longitudinal rail and provides means operable by a user to perform exercises. A carriage assembly is slidably engaged with the at least one longitudinal rail and serves to slidably support the weight of a user as the carriage assembly translates fore and aft along the longitudinal rail. A resistance structure is operably connected to the carriage assembly and to the longitudinal rail proximate the fore end of the longitudinal rail. The resistance structure serves to provide resistance to translational movement of the carriage assembly and pivotal movement of the lever structure. A cable is connected at its ends to the carriage assembly and to the lever structure and serves to coordinate translational movement of the carriage assembly with pivotal movement of the lever structure. A pulley is rotatably connected to the at least one longitudinal rail proximate the aft end of the longitudinal rail and serves to guide the cable ends to the carriage assembly and to the lever structure. A seat is positioned on the carriage assembly for sitting by a user, who operates the exercise machine by cyclically pivoting the lever structure.

DETAILED DESCRIPTION OF THE INVENTION

Figure 1:
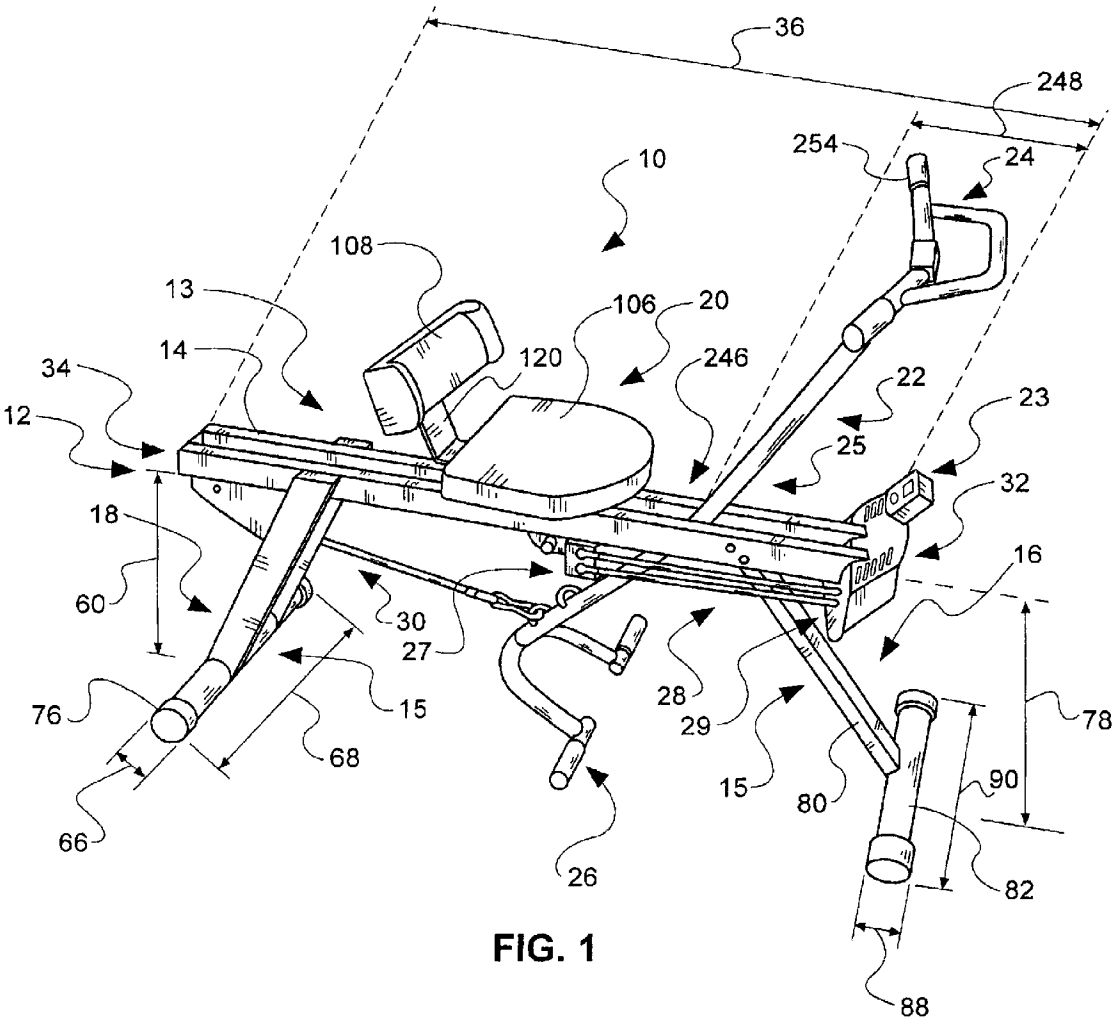
FIG. 1 is a perspective view of a preferred embodiment of the exercise machine of the present invention.

Referring to FIG. 1, the exercise machine 10 has a frame 12 that includes a rail means 13 for slidably supporting a carriage assembly thereon, together with the weight of a user, and a support means 15 for supporting the rail means 13 above a support surface. A carriage means 19 slidably supports the weight of a user on the rail means 13. A resistance means 28 for providing resistance to movement has a first end 27 connected to the carriage means 19 and a second end 29 connected to the rail means 13 proximate the fore end 32 of the rail means 13. A lever means 21 for operating the exercise machine by a user is pivotally connected to the rail means 13. A cable means 30 connects the lever means 21 to the carriage means 19, which is itself connected to the resistance means 28. A seat means 20 is connected to the carriage means 19. A hand grip assembly 24 and a foot grip assembly 26 are connected the lever means 21. A foot support assembly 23 is connected to the rail means 13 proximate the fore end 32 of the rail means 13.

As illustrated in FIGS. 20–23, a user operates the exercise machine 10 by sitting on the seat means 20 and by cycling the hand grip assembly 24 toward and away from him or herself. The user may position his or her feet on the foot grip assembly 26 or on the foot support assembly 23. When the user's feet are positioned on the foot support assembly 23, a standard rowing-type exercise may be performed. When the user's feet are positioned on the foot grip assembly 26, a modified rowing-type exercise may be performed. Details of the foregoing components of the exercise machine 10 and the construction and operation thereof are explained more fully below.

A preferred embodiment of the frame 12 includes a pair of longitudinal rails 14 as the rail means 13 and a fore support assembly 16 and an aft support assembly 18 as the support means 15. The pair of longitudinal rails 14 is sized and constructed to support the weight of a user and to enable slidable disposition of the carriage means 19 thereon. The fore support assembly 16 and the aft support assembly 18 are likewise sized and constructed to support the weight of a user, but are also sized to prevent the exercise machine 10 from tipping over sideways during use.

The pair of longitudinal rails 14 has a fore end (or first end) 32 and an aft end (or second end) 34. The fore and the aft ends 32, 34 are separated by a length 36 that is from about four (4) feet to about six (6) feet, and is preferably about five (5) feet. Each one of the pair of longitudinal rails 14 is preferably constructed of mild steel and square or rectangular in cross section. The cross sectional dimensions of each rail are from about one (1) inch to about four (4) inches in height 46 and from about one (1) inch to about three (3) inches in width 48. Preferably, the cross sectional dimensions of each rail are about three (3) inches in height 46 and about one and one-half (1.5) inches in width 48. The individual rails are spaced from each other a distance 50 that is about one (1) inch to about six (6) inches and, preferably, is about four (4) inches. The pair of longitudinal rails 14 are secured together by an aft end-plate 52 and by a fore end-plate 54. The end-plates 52, 54 are preferably welded to the pair of longitudinal rails 14, but may be secured by other suitable means, such as by nuts and bolts, for example.

It is noted here that the pair of longitudinal rails 14 described herein and above is but a specific embodiment of the rail means 13, which functions to slidably support the carriage means 19, together with the weight of a user. Thus, and by way of contemplated alternatives, the rail means 13 may also comprise not just a pair of rails, but a single rail or a plurality of three or more rails. Further, each rail, whether a single rail or a member of a plurality of rails, need not be rectangular, but may exhibit other cross sectional geometries, such as triangular or circular.

As is discussed below, various options—e.g., roller assemblies—exist for the purpose of slidably engaging the carriage means 19 to the rail means 13.

Figure 2:
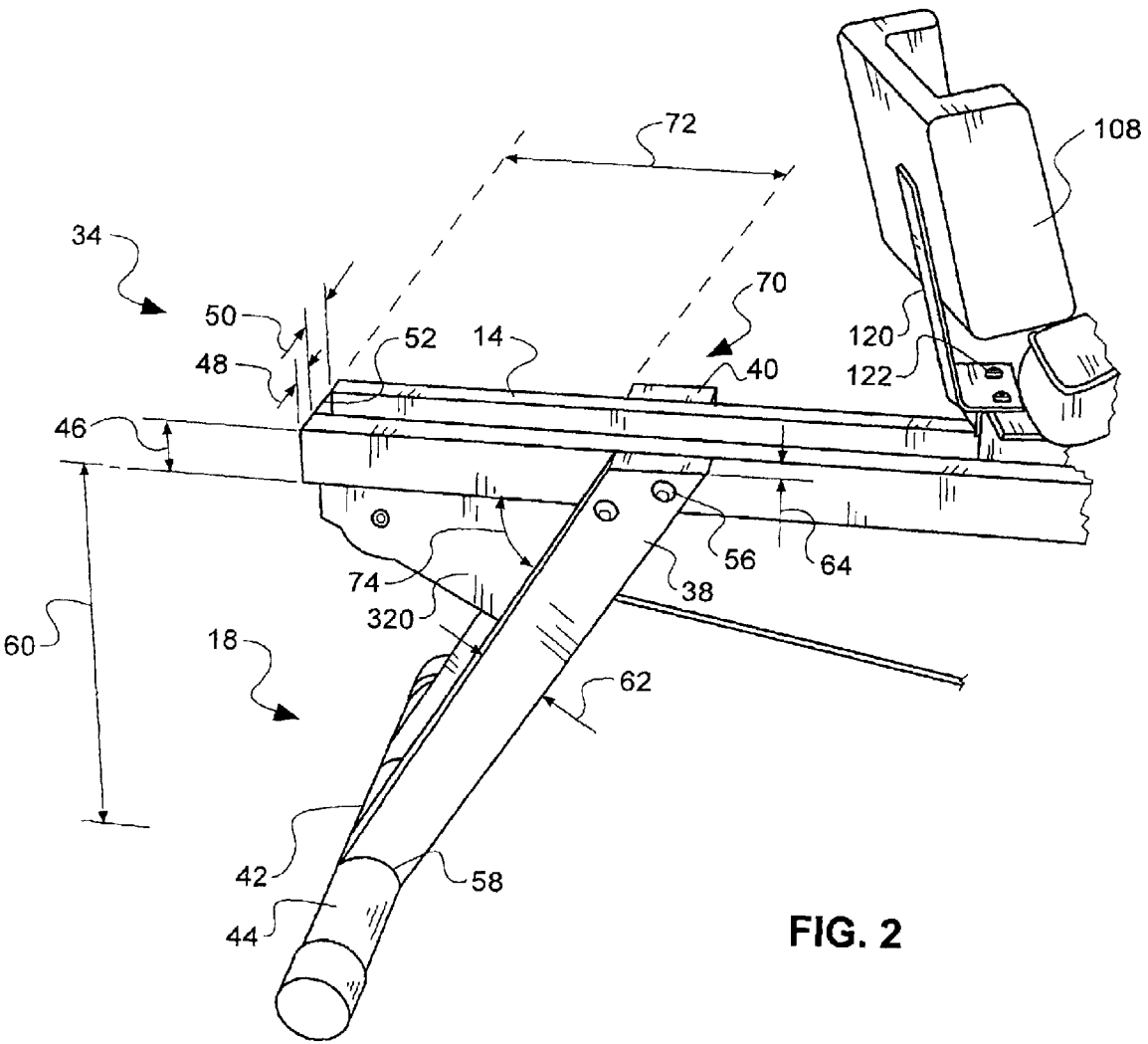
FIG. 2 is a perspective view of the aft-portion of the exercise machine illustrated in FIG. 1.

Referring to FIG. 2, the aft support assembly 18 is structured for supporting the aft end 34 of the pair of longitudinal rails 14 at an aft elevation 60 above the support surface and includes a pair of support members 38 and an aft transverse support member 44. The aft elevation 60 may be from about two (2) feet to about four (4) feet in height and is, preferably, about three (3) feet in height.

Each one of the support members 38 is preferably constructed of mild steel and square or rectangular in cross section, although they may be circular or ovoid in cross section as well. The cross sectional dimensions of each of the support members 38 are from about one (1) inch to about four (4) inches in height 62 and from about one (1) inch to about three (3) inches in width 64. Preferably, the cross sectional dimensions of each of the support members 38 are about three (3) inches in height 62 and about one and one-half (1.5) inches in width 64. The aft transverse support member 44 is preferably constructed of mild steel and circular in cross section. The cross sectional dimension, or diameter, of the aft transverse support member 44 may be from about one (1) inch to about three (3) inches in diameter 66 and is, preferably, about two (2) inches in diameter 66. The longitudinal dimension 68 of the aft transverse support member 44 may be from about two (2) feet to about four (4) feet in length and is, preferably, about three (3) feet in length.

Each of the support members 38 has a first end 40 that is connected to a respective one of the pair of longitudinal rails 14 and a second end 42 that is connected to the aft transverse support member 44. Each of the first ends 40 of the support members 38 is connected to the respective one of the pair of longitudinal rails 14 using any suitable means, such as by nut and bolt assemblies 56. Preferably, two nut and bolt assemblies 56 are used to secure each of the support members 38 to the respective one of the pair of longitudinal rails 14. Welding (not illustrated) may be used as an alternative to, or in conjunction with, the nut and bolt assemblies 56. Each of the second ends 42 are connected to the aft transverse support member 44 using any suitable means, such as, and preferably, by welded joints 58. The point of connection 70 of each support member 38 to its respective one of the pair of longitudinal rails 14 is defined by a length 72, which may be from about six (6) inches to about two (2) feet and is, preferably, about one (1) foot. Each support member 38 slopes downward and aft at an angle 74, which may be from about sixty (60) degrees to about eighty (80) degrees and is, preferably, about seventy (70) degrees. End caps 76 are positioned over the two ends of the aft transverse support member 44. The end caps 76 are preferably rubber or plastic and are frictionally engaged to the ends of the aft transverse support member 44.

Figure 3:
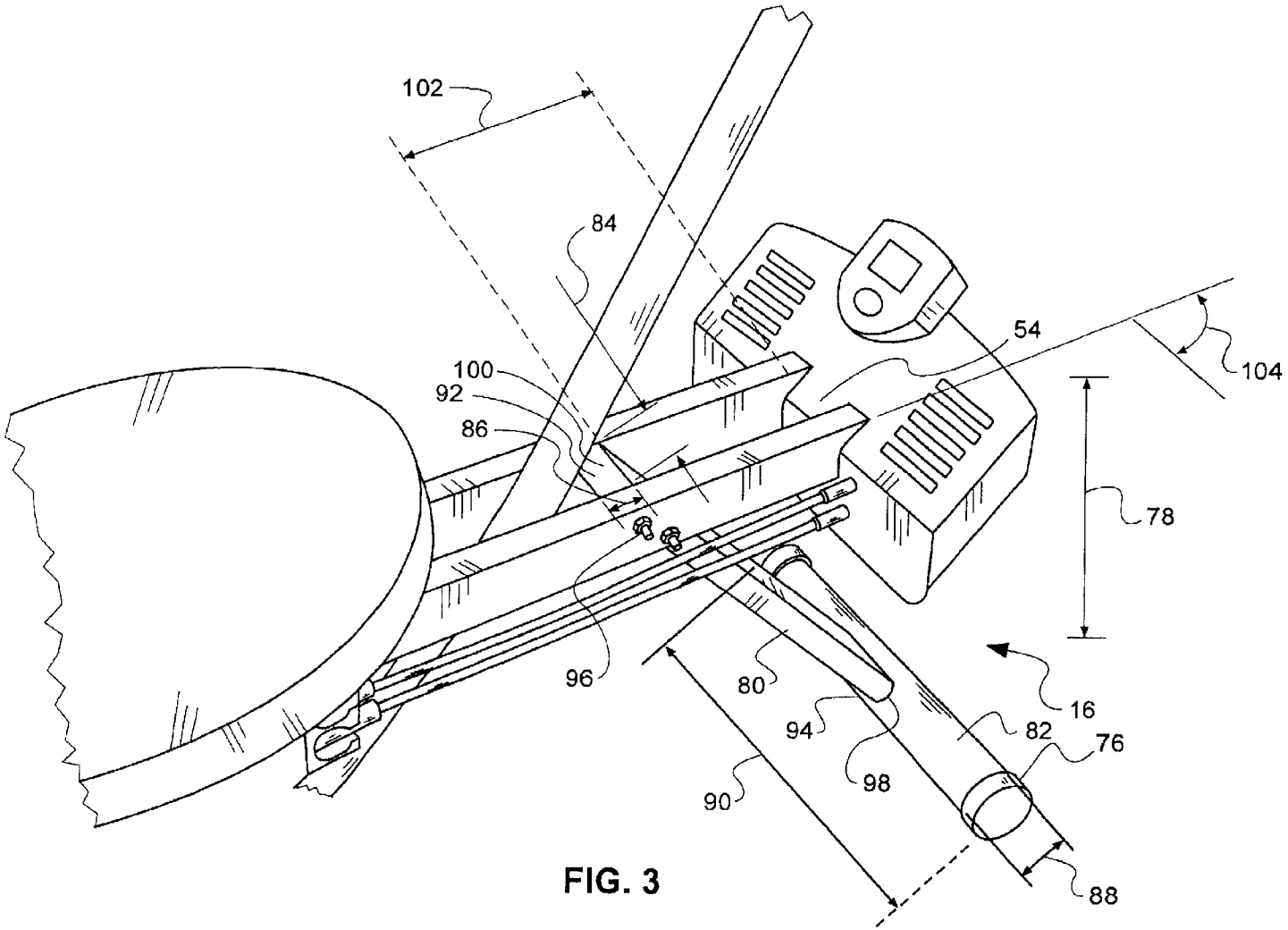
FIG. 3 is a perspective view of the fore-portion of the exercise machine illustrated in FIG. 1.

Referring to FIG. 3, the fore support assembly 16 is structured for supporting the fore end 32 of the pair of longitudinal rails 14 at a fore elevation 78 above the support surface and includes a support member 80 and a fore transverse support member 82. The fore elevation 78 may be from about two (2) feet to about four (4) feet in height and is, preferably, about three (3) feet in height. It is noted that the fore elevation 78 need not be identical to the aft elevation 60, as non-equal elevations 60, 78 are indeed contemplated for use with the present invention, such that the pair of longitudinal rails 14 may exhibit a positive or a negative slope in the longitudinal direction with respect to the support surface.

The support member 80 is preferably constructed of mild steel and square or rectangular in cross section, although it may be circular or ovoid in cross section as well. The cross sectional dimensions of the support member 80 are from about one (1) inch to about four (4) inches in height 84 and from about one (1) inch to about three (3) inches in width 86. Preferably, the cross sectional dimensions of the support member 80 are about three (3) inches in height 84 and about one and one-half (1.5) inches in width 86. The fore transverse support member 82 is preferably constructed of mild steel and circular in cross section. The cross sectional dimension of the fore transverse support member 44 may be from about one (1) inch to about three (3) inches in diameter 88 and is, preferably, about two (2) inches in diameter 88. The longitudinal dimension 90 of the fore transverse support member 82 may be from about two (2) feet to about four (4) feet in length and is, preferably, about three (3) feet in length.

The support member 80 has a first end 92 that is connected to each one of the pair of longitudinal rails 14 and a second end 94 that is connected to the fore transverse support member 82. The first end 92 of the support member 80 is connected to the pair of longitudinal rails 14 using and suitable means, such as by nut and bolt assemblies 96. Preferably, two of the nut and bolt assemblies 96 are used to secure the support member 80 to the pair of longitudinal rails 14. Welding (not illustrated) may be used as an alternative to, or in conjunction with, the nut and bolt assemblies 96. The second end 92 is connected to the fore transverse support member 82 using any suitable means, such as, and preferably, by welded joints 98. The point of connection 100 of the support member 82 to the pair of longitudinal rails 14 is defined by a length 102, which may be from about six (6) inches to about two (2) feet and is, preferably, about one (1) foot. The support member 82 slopes downward and fore at an angle 104, which may be from about sixty (60) degrees to about eighty (80) degrees and is, preferably, about seventy (70) degrees. End caps 76 are positioned over the two ends of the fore transverse support member 82. The end caps 76 are preferably rubber or plastic and are frictionally engaged to the ends of the fore transverse support member 82.

Referring to FIGS. 4–7, a preferred embodiment of the carriage means 19 is a roller and frame assembly 110. The roller and frame assembly 110 includes a pair of side by side members 130, each of which has an above-rail portion 132, a below-rail portion 134 and a resistance means engaging portion 135, and a plurality of roller wheels. The pair of side by side members 130, together with the associated portions 132, 134 and 135, is preferably symmetric in layout and formed from a single blank of mild steel, having a thickness of about one-eighth (⅛) of an inch to about one-quarter (¼) of an inch, and preferably about one-eighth (⅛) of an inch. Illustrated in FIG. 7, for example, is a layout for a single blank 186 of mild steel from which the pair of side by side members 130 is constructed.

Figure 7:
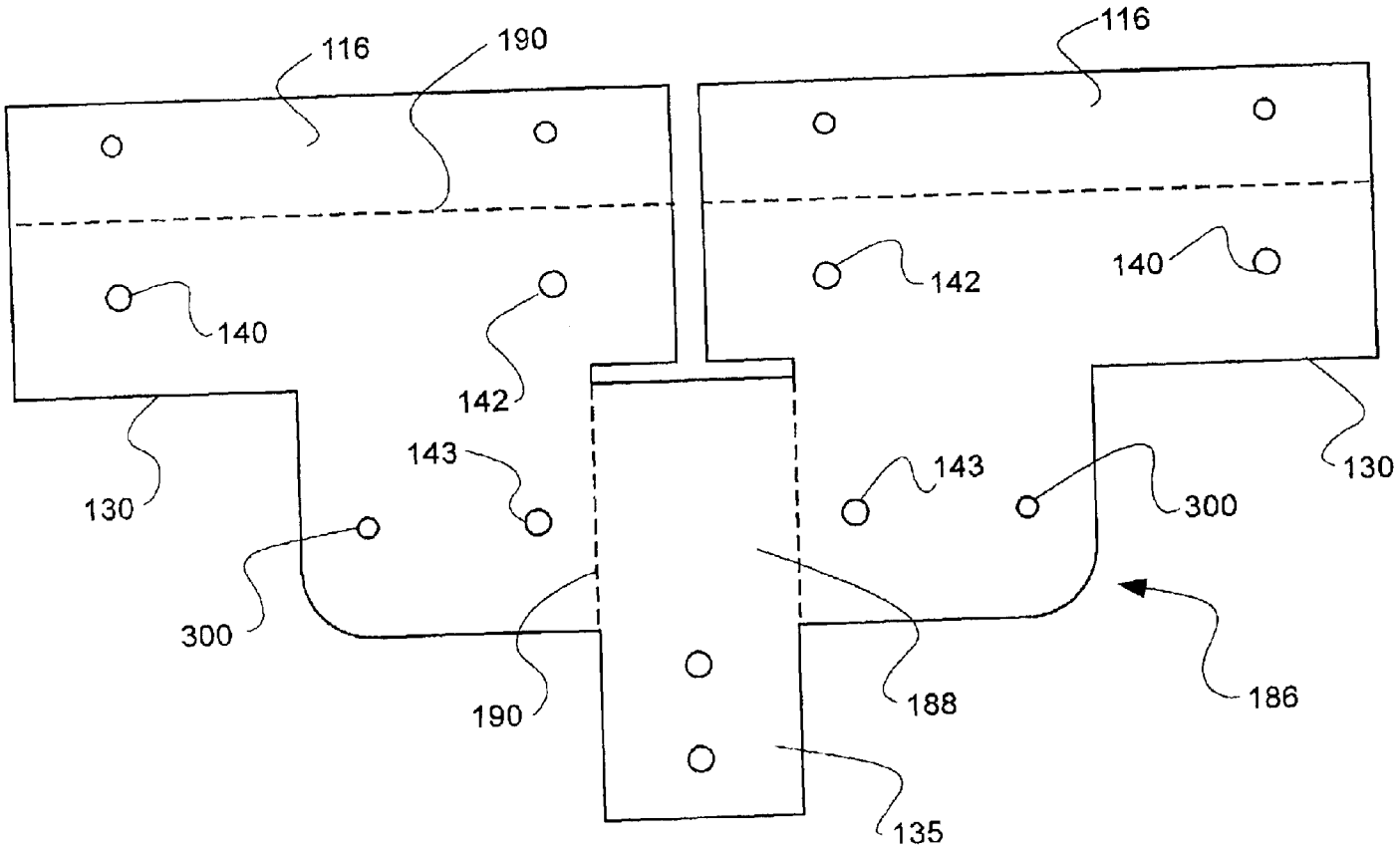
FIG. 7 is a plan view of a blank layout used in constructing the roller and frame assembly.

More particularly, the side by side members 130 are shown on either side of a central element 188. At the bottom of the central element 188 is the resistance means engaging portion 135. Located above each one of the pair of side by side members 130 is an overhang portion 116 for mounting the seat means 20 thereto. Various apertures—e.g., a first aperture 140 and a second aperture 142—are also illustrated in FIG. 7, as are the bend lines (indicated by dotted lines 190) where the blank 186 may be bent to form the various portions that are above and below described. Constructing the roller and frame assembly 110 in this fashion greatly increases its strength once assembled.

Figure 5:
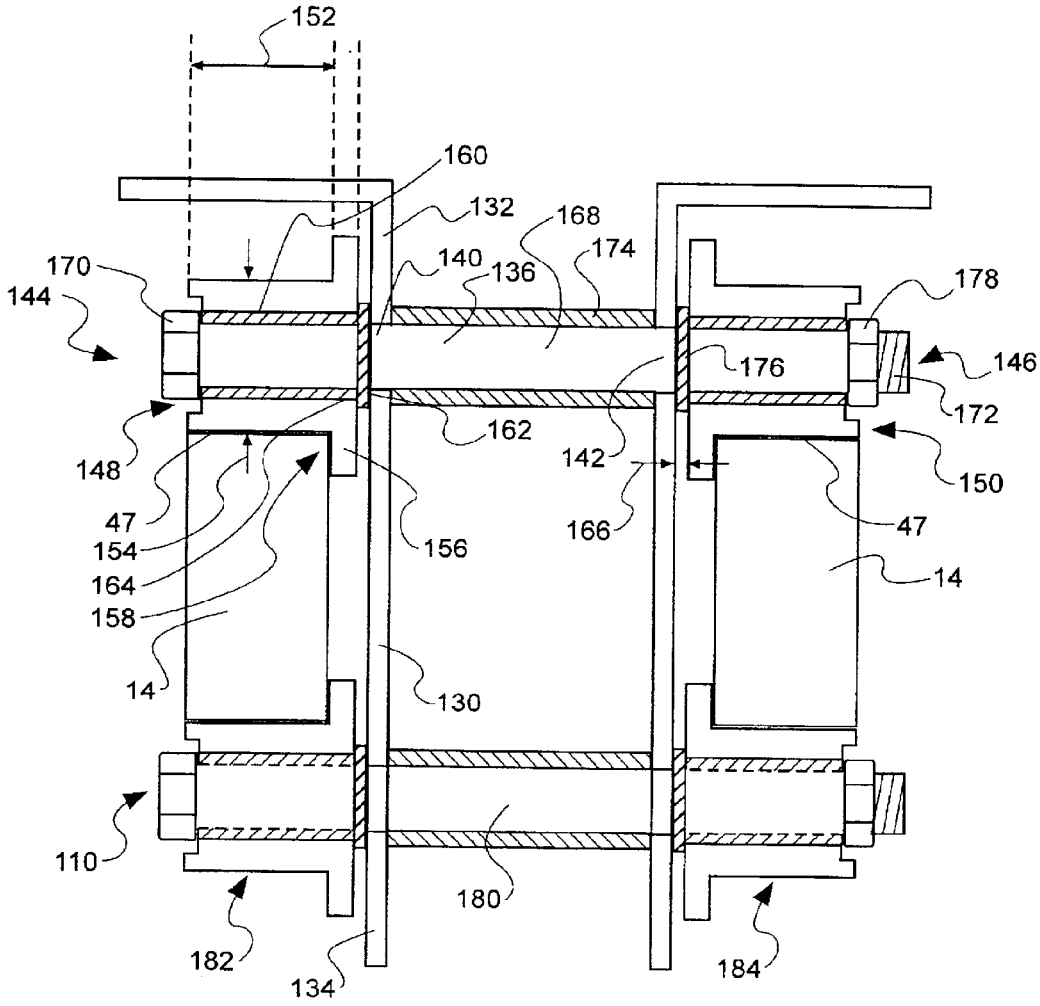
FIG. 5 is a longitudinal view of the roller and frame assembly, showing one of the two upper roller assemblies and the single lower roller assembly.
Figure 6:
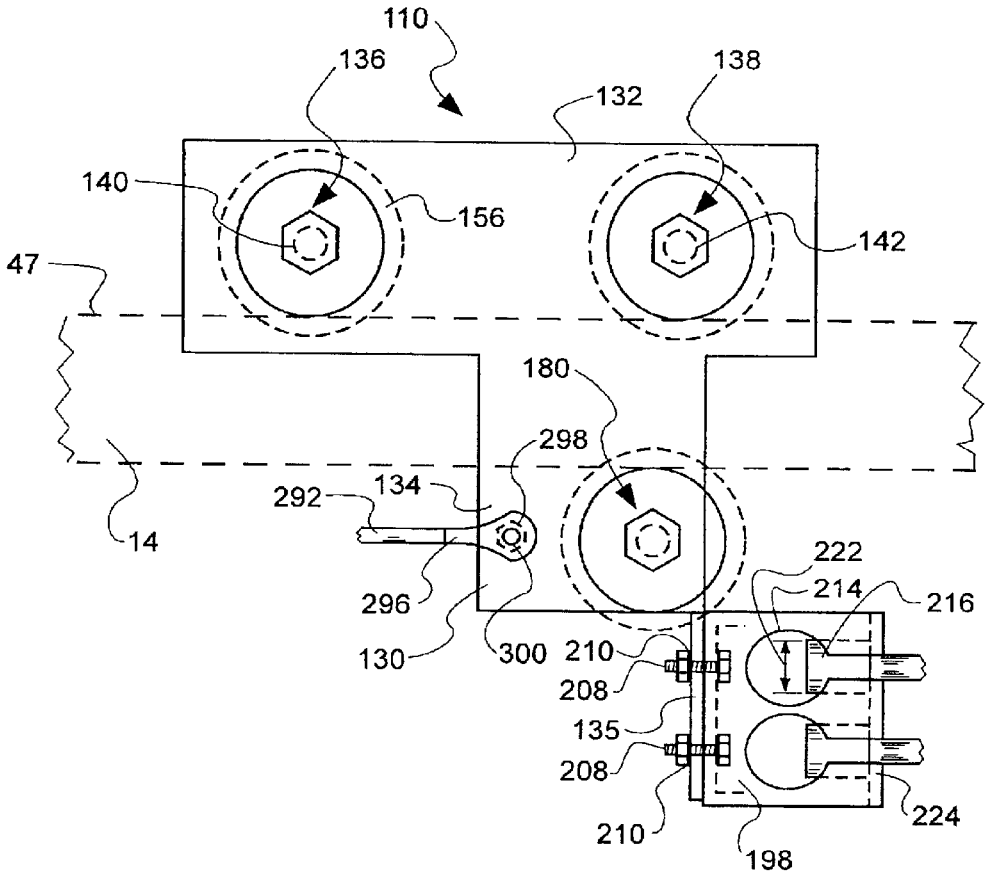
FIG. 6 is a side view of the roller and frame assembly.

The above-rail portion 132 of each of the side by side members 130 has a first aperture 140 and a second aperture 142 through which a first shaft member (or axle) 136 and a second shaft member (or axle) 138 extend, respectively (FIG. 5 illustrates the first shaft member 136 and related structure only). Each of the shaft members 136, 138 has a first end 144 and a second end 146 at which a first roller wheel 148 and a second roller wheel 150 are positioned, respectively. Each roller wheel 148, 150 is sized and configured to roll on the upper surface 47 of its respective one of the pair of longitudinal rails 14.

The first roller wheel 148, for example, has a width 152 that corresponds to the width 48 of its respective longitudinal rail (only the first roller wheel 148 need be discussed as all the roller wheels are essentially identical). The diameter 154 of the first roller wheel 148 may be from about one (1) inch to about three (3) inches, and is, preferably, about one and one-half (1.5) inches. The first roller wheel 148 further has a lip portion 156 that serves to prevent sideways movement of the roller and frame assembly 110 by brushing against an edge 158 of the adjacent longitudinal rail. The first roller wheel 148 further has a bearing means 160 for reducing rolling friction. The bearing means 160 is preferably of the sealed roller bearing variety, but may be of any other variety of bearing that is used for exercise equipment. A washer element 162 is disposed between the inner end 164 of the bearing means 160 and the adjacent side by side member 130. The washer element 162 ensures that a clearance 166 of about one-thirty-second (1/32) of an inch to about one-quarter (¼) of an inch and, preferably, about one-eighth (⅛) of an inch is present to prevent sticking friction between the first roller wheel 148 and the adjacent one of the side by side members 130.

The first roller wheel 148 and the second roller wheel 150 are assembled into the roller and frame assembly 110 by first sliding the first roller wheel 148 onto the first shaft member 136, which is preferably a bolt 168 having a head portion 170 and a threaded portion 172. A washer element 162 is then slid onto the bolt 168. Prior to the bolt 168 being inserted through the first aperture 140, a spacer element 174 is positioned, if desired, between the side by side members 130 adjacent the first aperture 140. The bolt 168 is then slid through the first aperture 140, the spacer element 174 and then the second aperture 142. A second washer element 176 is then slid onto the bolt 168, followed by the second roller wheel 150. Finally, a nut 178 is threaded onto the threaded portion 172 of the bolt 168.

The above described process of assembling the first roller wheel 148 and the second roller wheel 150 into the roller and frame assembly 110 is repeated for the second shaft member 138 and its respective pair of roller wheels. The process is also repeated for a third shaft member 180 and its respective first roller wheel 182 and second roller wheel 184. Apertures 143 in each of the side by side members 130 are provided for the third shaft member 180. The third shaft member 180 and its respective roller wheels 182, 184 function to prevent the roller and frame assembly 110 from rotating about one of the first shaft member 136 or the second shaft member 138 during use. When so assembled, the roller and frame assembly 110 functions to slidably support the seat means 20 on the pair of longitudinal rails 14, together with the weight of the user.

It is noted here that the carriage means 19 should have the ability to traverse the rail means 13, fore and aft, with as little friction as possible while supporting the weight of a user. Those skilled in the art may recognize that the carriage means 19—e.g., the roller and frame assembly 110—may be constructed in alternate ways, using, for example, different qualities or varieties of bearings, fewer or greater numbers of shaft members and their associated roller wheels, or different constructions or layouts for the side by side members. The carriage means 19 could also be constructed not with roller wheels at all, but with low-friction sliding surfaces. An example of this latter type of construction may be found in U.S. Pat. No. 5,013,033 (Watterson et al.), the disclosure of which is incorporated herein by this reference. Thus, the above description is not meant to be limiting, but serves to describe only a preferred construction of the carriage means 19.

Figure 4:
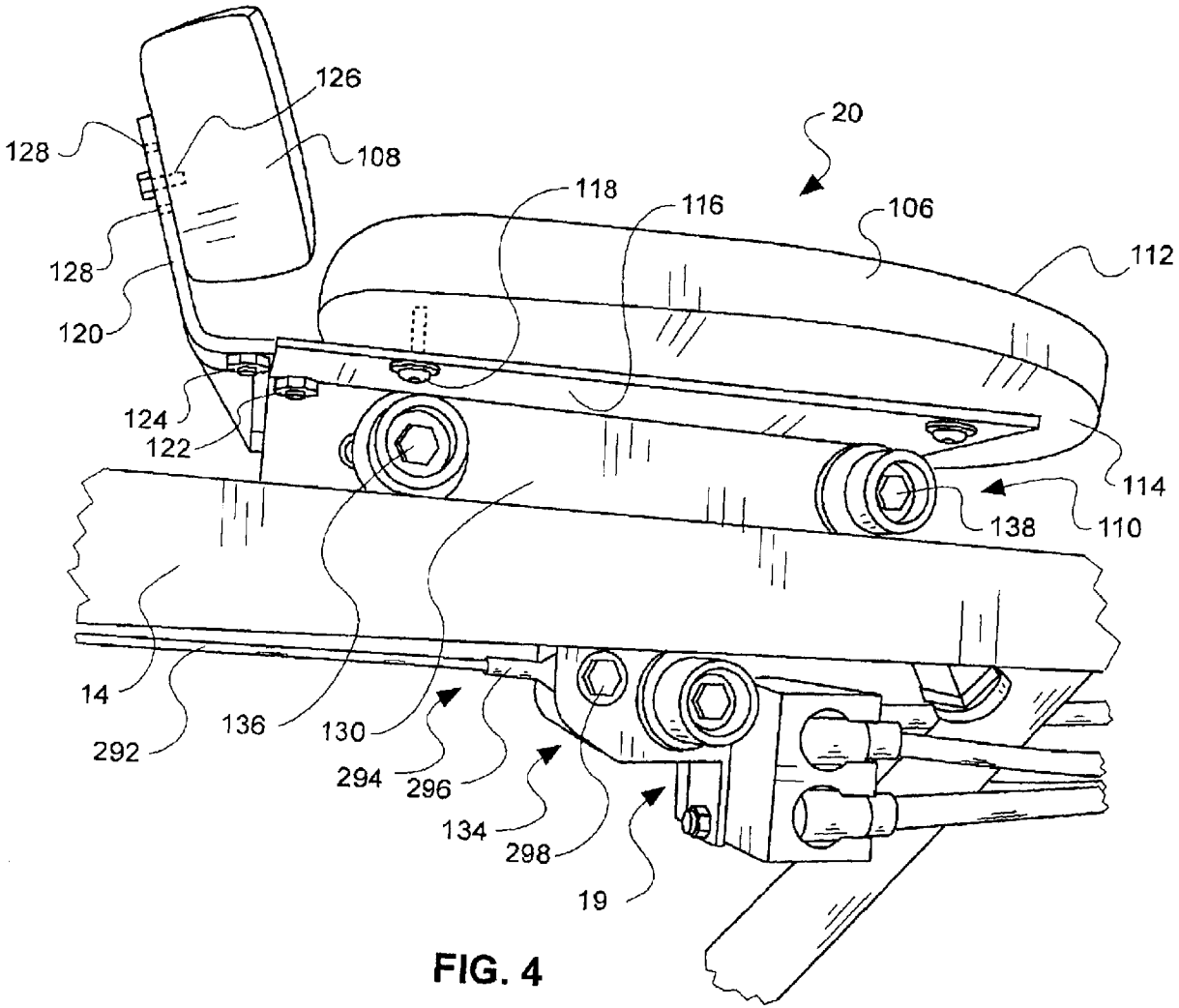
FIG. 4 is a perspective view of the underside of the seat means of the exercise machine illustrated in FIG. 1.

Referring to FIG. 4, the seat means 20 includes a buttocks support 106 and a lower back support 108. The buttocks support 106 is preferably constructed using a soft inner material (not illustrated) that is suitable for sitting on. The soft inner material is preferably positioned on the upperside of a wooden frame (not illustrated) and then covered by a leather or plastic covering 112 that is itself fastened to the underside 114 of the wooden frame. The leather or plastic covering 112 is fastened to the underside 114 of the wooden frame using any suitable means, such as by stapling, for example. The underside 114 of the wooden frame is then secured to an overhang portion 116 of the roller and frame assembly 110 using screws 118. A similar construction is used for the lower back support 108. The main difference between the two constructions is that the lower back support 108 is adjustably secured to a bracket 120 that is itself secured to the roller and frame assembly 110 using a nut and bolt means 122. An angle bracket 124 is used to strengthen the bracket 120 and is secured to the bracket 120 through welded joints. The lower back support 108 is adjustably secured to the bracket 120 using a bolt means 126 in conjunction with a series of spaced holes 128 in the bracket 120. The dimensions of the buttocks support 106 and the lower back support 108 are selected, for example, to be compatible with the dimensions of an adult user of average size.

Figure 8:
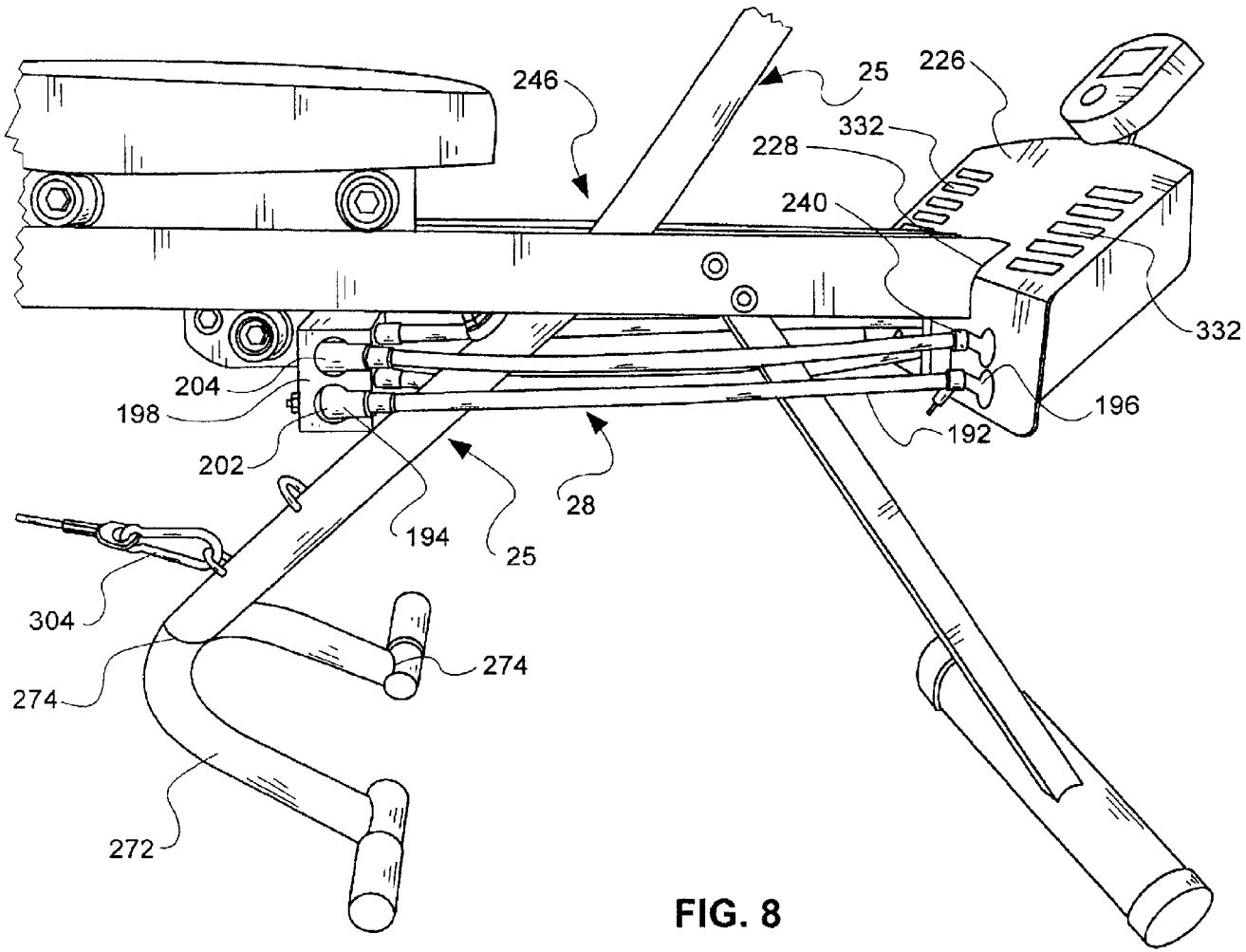
FIG. 8 is a perspective view of the exercise machine of FIG. 1, showing a preferred embodiment of the resistance means.

Referring to FIG. 8, a preferred structure for the resistance means 28 is illustrated. The preferred structure includes a plurality of four elastic cords 192 arranged in a two-by-two format. Each of the elastic cords 192 has a first end 194 and a second end 196 (only one cord 192 need be discussed as each cord is similar). The first end 194 of the elastic cord 192 is removably attached to a bracket means 198 that is itself secured to the resistance means engaging portion 135 of the roller and frame assembly 110. Nut and bolt means 208 are used to secure the bracket means 198 to the resistance means engaging portion 135. Apertures 210 are drilled in both the bracket means 198 and the resistance means engaging portion 135 for the nut and bolt means 208 to extend through. Welded joints (not illustrated) could be used as an alternative to the nut and bolt means 208.

Figure 9A:
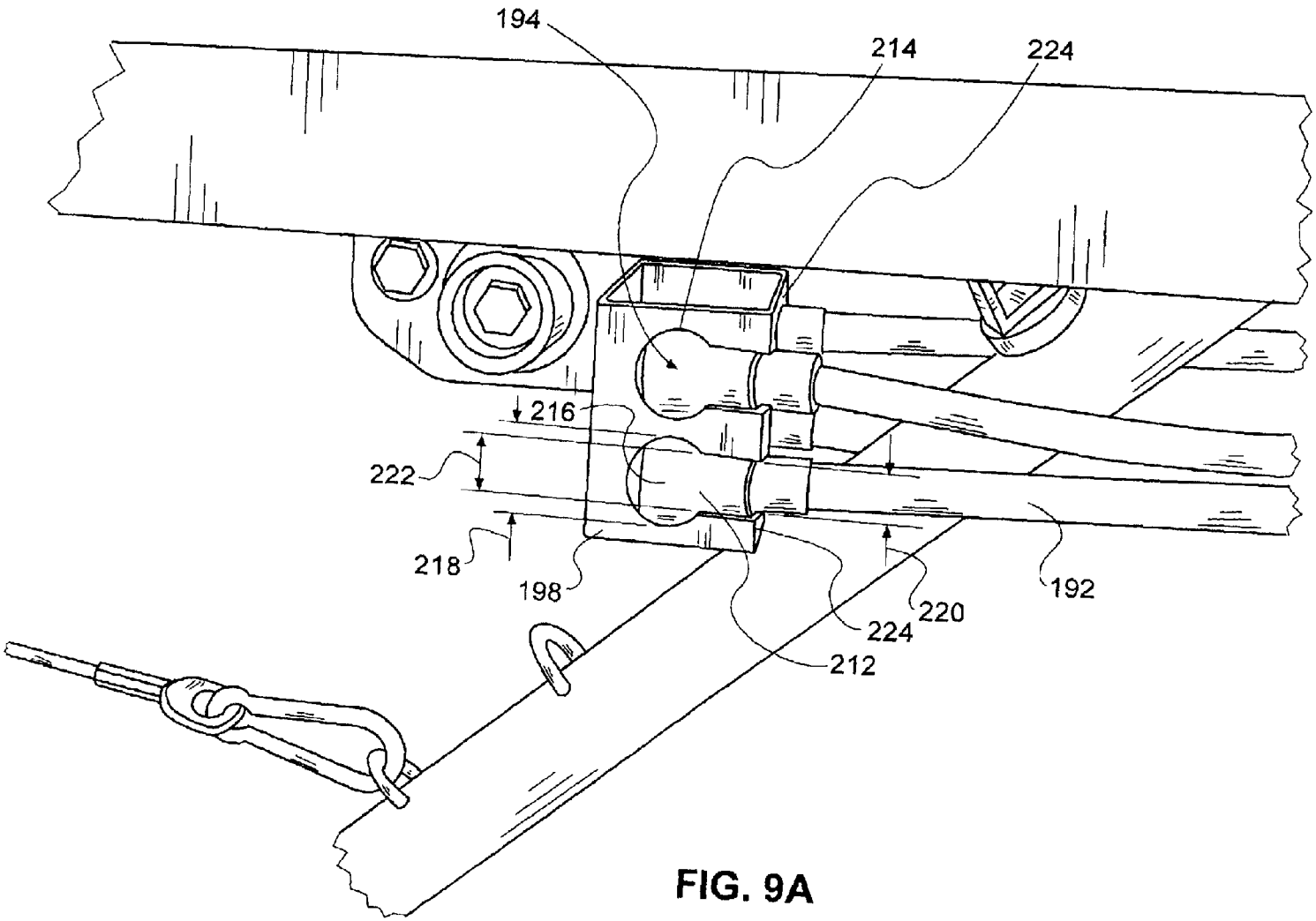
FIG. 9A is a close-up view of the aft-end of the resistance means illustrated in FIG. 8.

The bracket means 198 is preferably symmetric in layout and formed from a single blank of mild steel, having a thickness of about one-eighth (⅛) of an inch to about one-quarter (¼) of an inch, and preferably about one-eighth (⅛) of an inch. Illustrated in FIG. 10, for example, is a layout 200 for a single blank of mild steel from which the bracket means 198 is constructed (see also FIG. 9A). More particularly, the layout 200 illustrates a first female engaging slot 202 and a second female engaging slot 204 on each side of the resistance means engaging portion 135 of the roller and frame assembly 110. The dotted lines 206 indicate 90° degree bends that the blank of steel undergo to produce the bracket means 198. Constructing the bracket means 198 in this fashion greatly increases its strength when assembled to the resistance means engaging portion 135 of the roller and frame assembly 110.

Figure 9B:
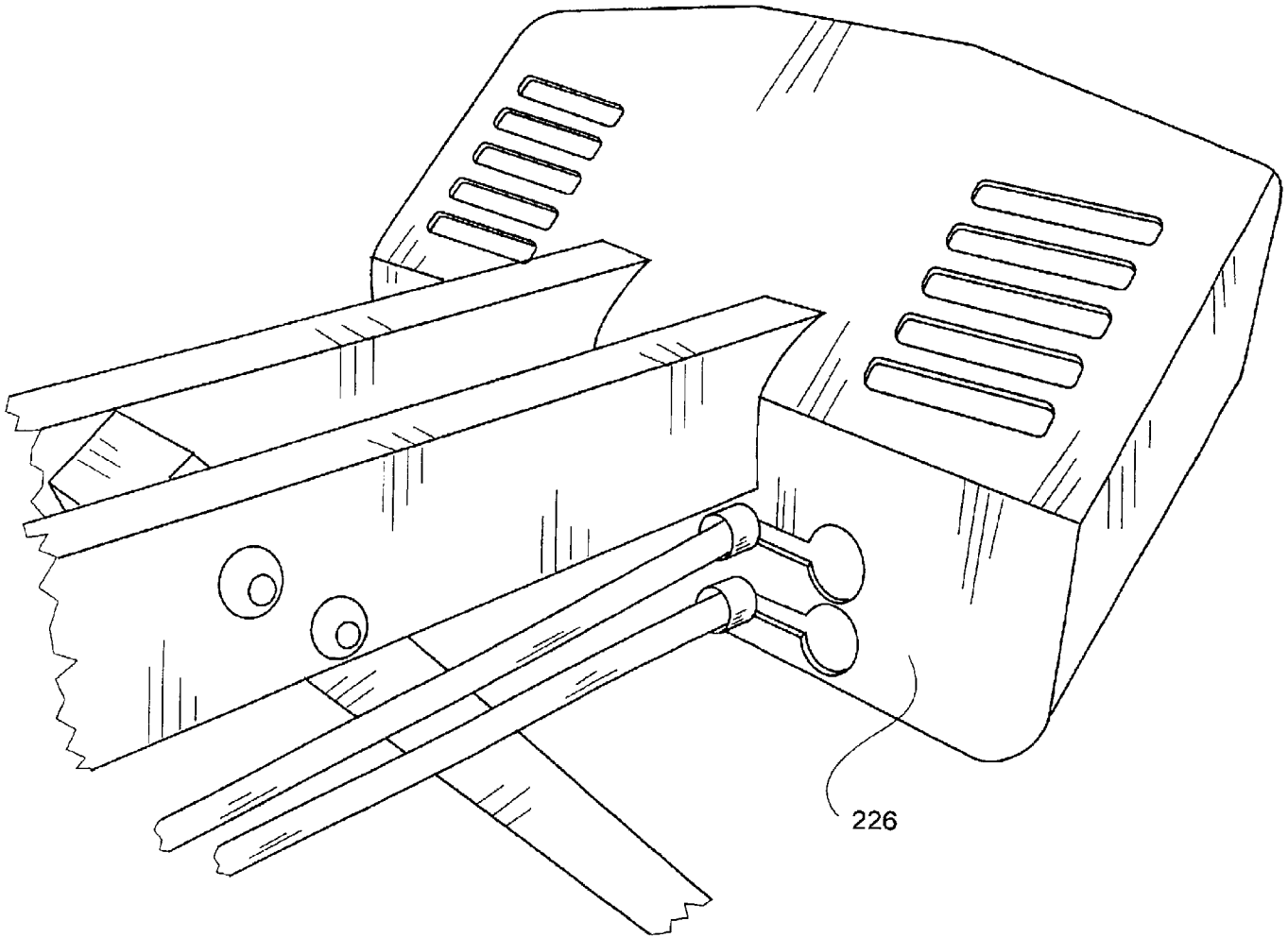
FIG. 9B is a close-up view of the fore-end of the resistance means illustrated in FIG. 8.
Figure 10:
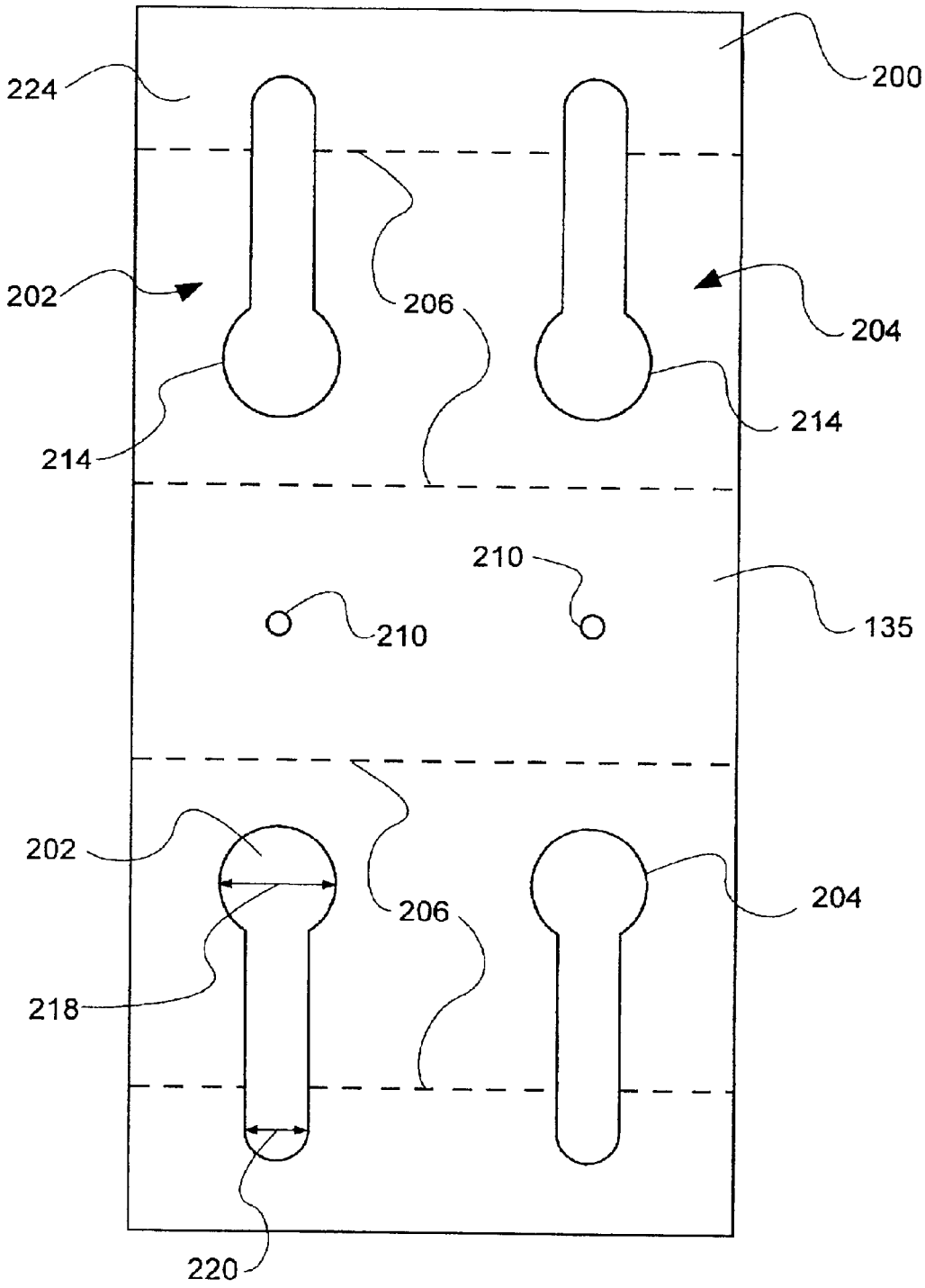
FIG. 10 is a plan view of a blank layout used in constructing the bracket means at the aft-end of the resistance means illustrated in FIG. 8.

Referring to FIGS. 8–10, the first end 194 of the elastic cord 192 has a male engaging means 212 for engaging the bracket means 198. The male engaging means 212 is secured to the elastic cord 192 using any suitable means, such as by crimping onto the cord. The male engaging means 212 has a head portion 216 that is cylindrical in shape and that has a diameter 222 that is preferably about one-half (½) of an inch. Each engaging slot 202, 204 (which are similar except for location on the bracket) of the bracket means 198 has a first diameter 218 and a second diameter 220, the second diameter 220 being smaller than the first diameter 218. The size for the first diameter 218 is preferably about three-quarters (¾) of an inch, while the size for the second diameter 220 is preferably about three-eighths (⅜) of an inch. The first end 194 of the elastic cord 192 is secured to the bracket means 198 by inserting the head portion 216 into the first diameter 218 and allowing the head portion 216 to abut the engaging fold 224 of the bracket means 198. Since the diameter 222 of the head portion 216 is larger than the second diameter 220, the head portion 216 will engage the bracket means 198 at the engaging fold 224 when a load is applied to the elastic cord 192.

Referring to FIG. 8, the second end 196 of the elastic cord 192 is removably attached to a second bracket means 226 that is itself secured to the longitudinal rails 14 proximate the fore end 32 of the longitudinal rails 14. Welded joints 228 are preferably used to secure the second bracket means 226 to the longitudinal rails 14, although nut and bolt means (not illustrated) could also be used. The second bracket means 226 is preferably symmetric in layout and formed from a single blank of mild steel, having a thickness of about one-eighth (⅛) of an inch to about one-quarter (¼) of an inch, and preferably about one-eighth (⅛) of an inch.

Figure 11:
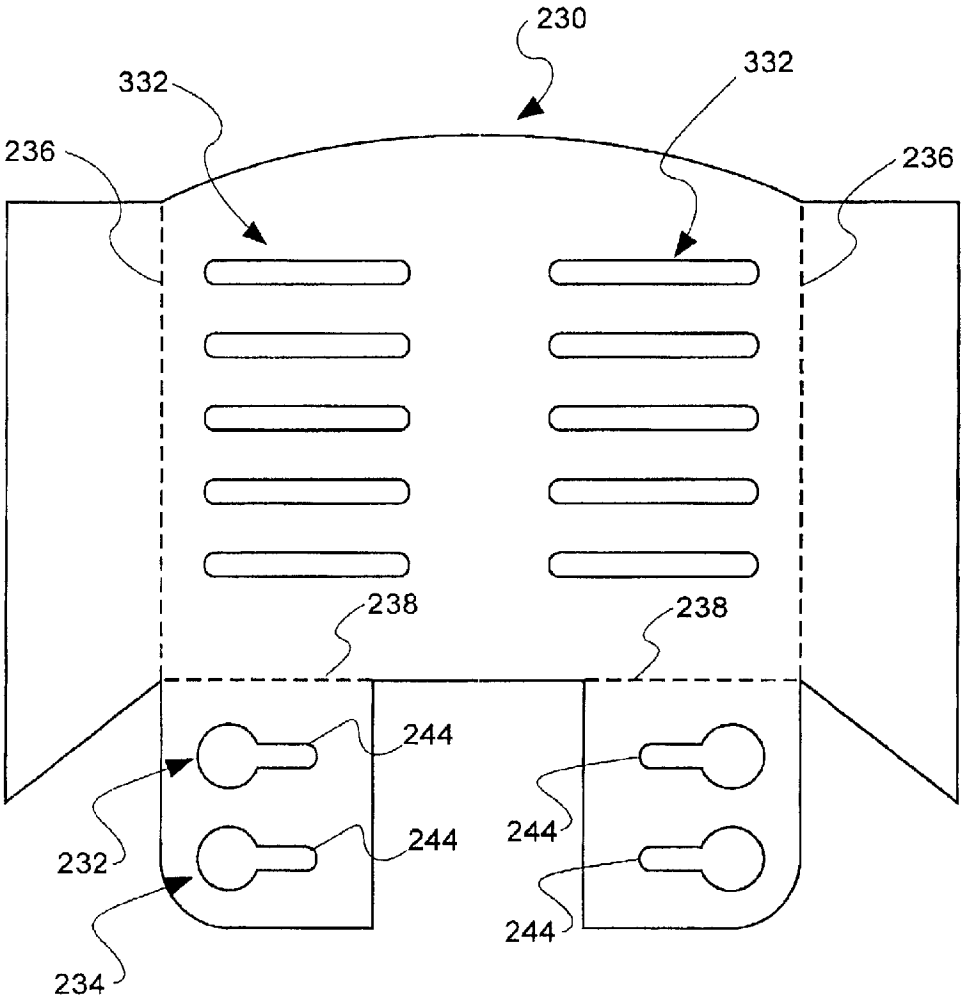
FIG. 11 is a plan view of a blank layout used in constructing the bracket means at the fore-end of the resistance means illustrated in FIG. 8.
Figure 12:
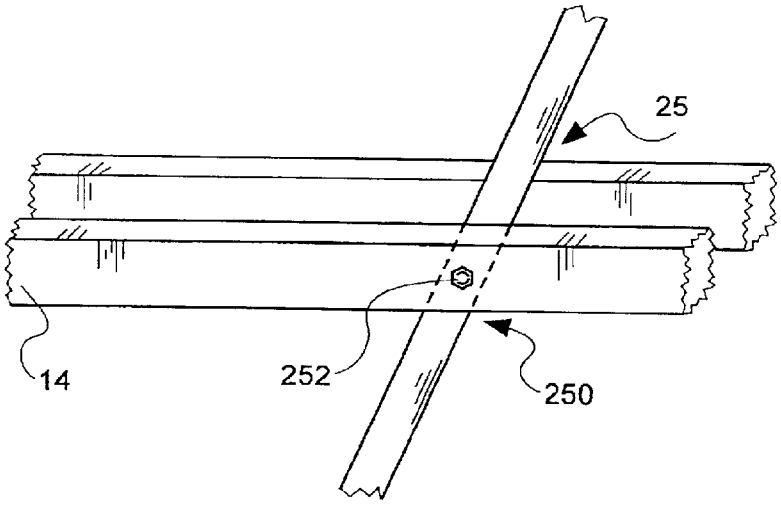
FIG. 12 illustrates a shaft means for pivotally connecting the hand and foot lever assembly to the pair of longitudinal rails.

Illustrated in FIG. 11, for example, is a layout 230 for a single blank of mild steel from which the second bracket means 226 is constructed (see also FIG. 9B). More particularly, the layout 230 illustrates a first female engaging slot 232 and a second female engaging slot 234 on each side of the second bracket means 226. Fore-end foot supports 332 are also indicated on either side of the layout 230. The first dotted lines 236 indicate 90° degree bends that the blank of steel undergo to produce the second bracket means 226, while the second dotted lines 238 indicate 45° degree bends. Constructing the second bracket means 226 in this fashion greatly increases its strength when secured to the longitudinal rails 14. The preferred construction also allows the fore-end foot supports 332 to be incorporated integrally into the second bracket means 226. It should be appreciated, however, that the fore-end foot supports 332 and the second bracket means 226 could be constructed separately using individual components.

The second end 196 of each of the elastic cords 192 has a male engaging means 240 that is similar to the male engaging means 212 previously discussed. The male engaging means 240 is secured to the elastic cord 192 using any suitable means, such as by crimping onto the cord. The male engaging means 240 is removably secured to the female engaging slots 232, 234 in the same fashion as above described. That is, the male engaging means 240 has a head portion 242 that is cylindrical in shape and that has a diameter that is preferably about one-half (½) of an inch. The engaging slots 232, 234, on the other hand, have first and second diameters that are, respectively, larger and smaller than the diameter of the head portion 242—say, about three-quarters (¾) of an inch and about three-eighths (⅜) of an inch, respectively. The second end 196 of the elastic cord 192 is secured to the second bracket means 226 by inserting the head portion 240 into the first diameter and allowing the head portion 242 to abut the engaging portion 244 of the second bracket means 226. Since the diameter of the head portion 242 is larger than the engaging portion 244, the head portion 242 will engage the second bracket means 226 when a load is applied to the elastic cord 192.

The preferred embodiment of the resistance means 28, as described above with respect to the plurality of four elastic cords 192 arranged in a two-by-two format, will provide, among other things, a resistive load to movement of the carriage means 19 when the carriage means 19 is slid toward the aft end of the exercise machine 10 from an at-rest position. Those skilled in the art may recognize that the resistance to movement provided by the resistance means 28 may be obtained in alternate ways, using, for example, gas cylinders, surgical tubing or coil springs. Each of these alternate embodiments of resistance means 28 need only be connected in a suitable fashion to the bracket means 198 and to the second bracket means 226 to provide the desired resistance to movement. Other alternatives to the resistance means 28 include clock-type springs connected to a cable reel. The clock-type spring would be mounted to the rail means and a cable that is wound on the cable reel would be connected to the carriage means 19. Thus, the above description of the plurality of four elastic cords 192 arranged in a two-by-two format is not meant to be limiting, but serves to describe only the preferred construction of the resistance means 28. Those skilled in the art may also recognize that differing resistance profiles may be obtained by simply adding or subtracting individual cords from the plurality of four elastic cords 192 arranged in a two-by-two format. Thus, the preferred embodiment described above offers flexibility in use in that a variety of resistance profiles for the exercise machine 10 may be achieved.

Referring to FIG. 1, a lever means 21 for operating the exercise machine 10 is pivotally connected to the rail means 13. The preferred structure for the lever means 21 is a hand and foot lever assembly 22, which includes a hand grip assembly 24, a foot grip assembly 26 and an intermediate shaft portion 25. Each of the component parts of the hand and foot lever assembly 22 are preferably constructed from mild steel tube stock, having an outer diameter from about one (1) inch to about two (2) inches and, preferably, about one and one-half (1.5) inches. The wall thickness of the tube stock is preferably about one-eighth (⅛) of an inch. The hand and foot lever assembly 22 is pivotally disposed at a pivot point 246 between the pair of longitudinal rails 14. The pivot point 246 is located a distance 248 aft of the fore end 32 of the longitudinal rails 14. The distance 248 that the pivot point 246 is located aft of the fore end 32 may be from about one (1) foot to about three (3) feet and is, preferably, about eighteen (18) inches in length. A pivot means 250 is used to pivotally mount the hand and foot lever assembly 22 to the pair of longitudinal rails 14. The pivot means 250 may take a variety of forms known to those skilled in the art. For example, a pivot pin or, similarly, a nut and bolt means 252 is used for pivotally mounting the intermediate shaft portion 25 to the pair of longitudinal rails 14.

The hand grip assembly 24 includes a pair of hand grip arms 254 that are connected to the hand and foot lever assembly 22 proximate the upper end of the intermediate shaft portion 25. The connection is made by and suitable means, such as by welded joints (not illustrated). A U-shaped cross member 256 is secured to the hand grip arms 254 at a location 258 that is intermediate the length 260 of each of the hand grip arms 254. The length 260 of each of the hand grip arms 254 may be from about one (1) foot to about two (2) feet and is, preferably, about eighteen (18) inches. The U-shaped cross member 256 is preferably secured to each of the hand grip arms 254 by welded joints (not illustrated). The U-shaped cross member 256, when attached to the hand grip arms 254, provides increased strength for the hand grip assembly 24.

Figure 14:
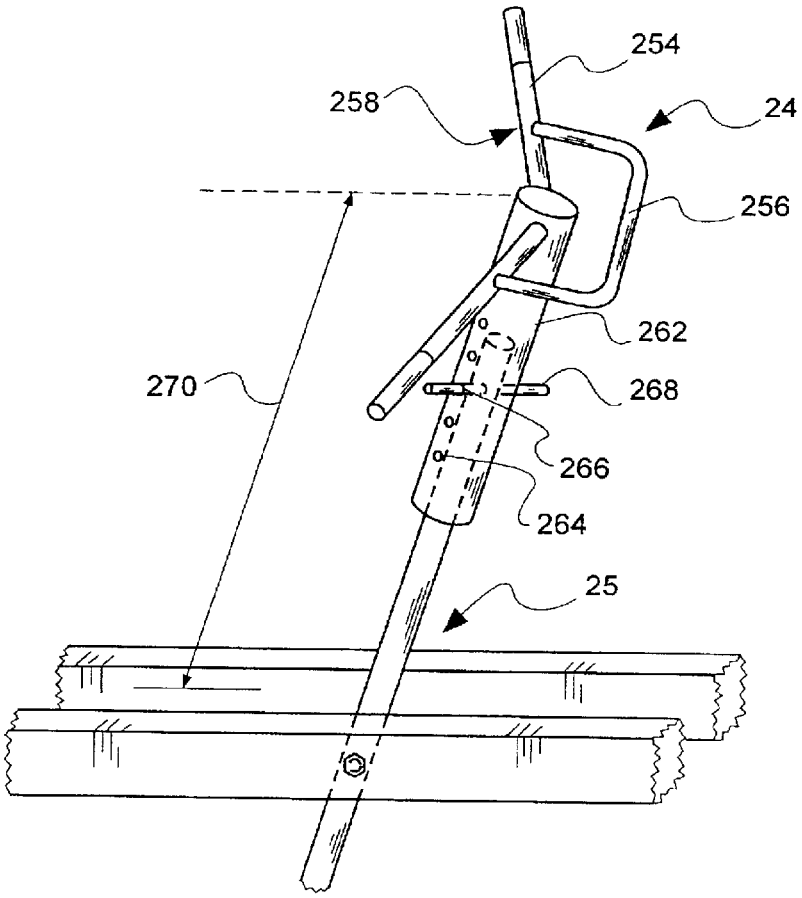
FIG. 14 illustrates a height adjustment mechanism for the hand grip assembly.
Figure 13:
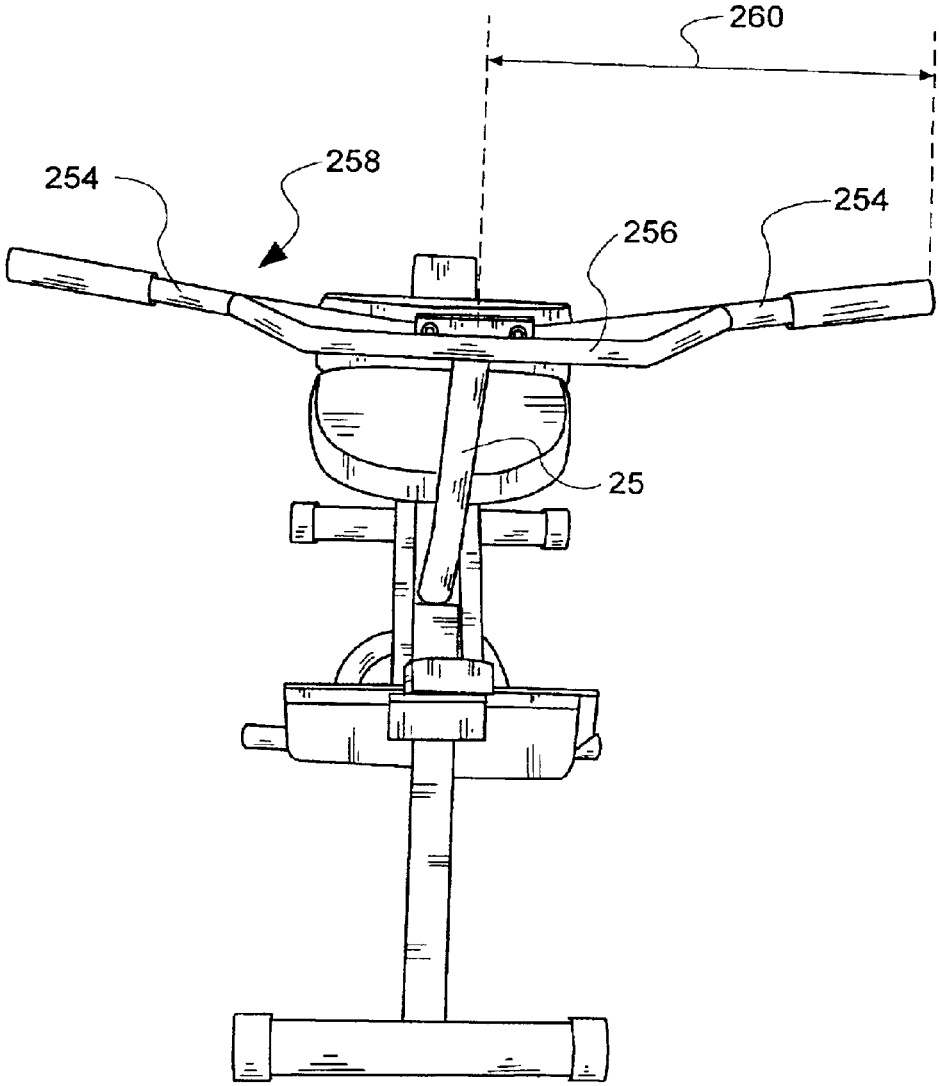
FIG. 13 is a frontal view of the exercise machine illustrated in FIG. 1.

Referring to FIG. 14, the hand grip assembly 24 may be made adjustable, if desired, on the intermediate shaft portion 25. For example, the hand grip arms 254 may be secured to a tube-like sleeve member 262 having a series of connecting apertures 264. The upper end of the intermediate shaft portion 25 would have a corresponding aperture 266. A pin means 268 could then be removably inserted through one of the series of connecting apertures 264 and the corresponding aperture 266 to provide a hand grip assembly that is adjustable in length 270 above the pair of longitudinal rails 14. The length 270 above the longitudinal rails is preferably about two (2) feet, but may be raised or lowered as desired by the user.

Referring to FIG. 8, the foot grip assembly 26 includes a U-shaped member 272 that is connected to the hand and foot lever assembly 22 proximate the lower end of the intermediate shaft portion 25. The connection is made by and suitable means, such as by welded joints 274. Foot grips (or pegs) 276 are connected at the ends 278 of the U-shaped member 272, again, using any suitable means, such as by welded joints 274. The length 280 of the U-shaped member may be from about six (6) inches to about two (2) feet and is, preferably, about one (1) foot.

Figure 15:
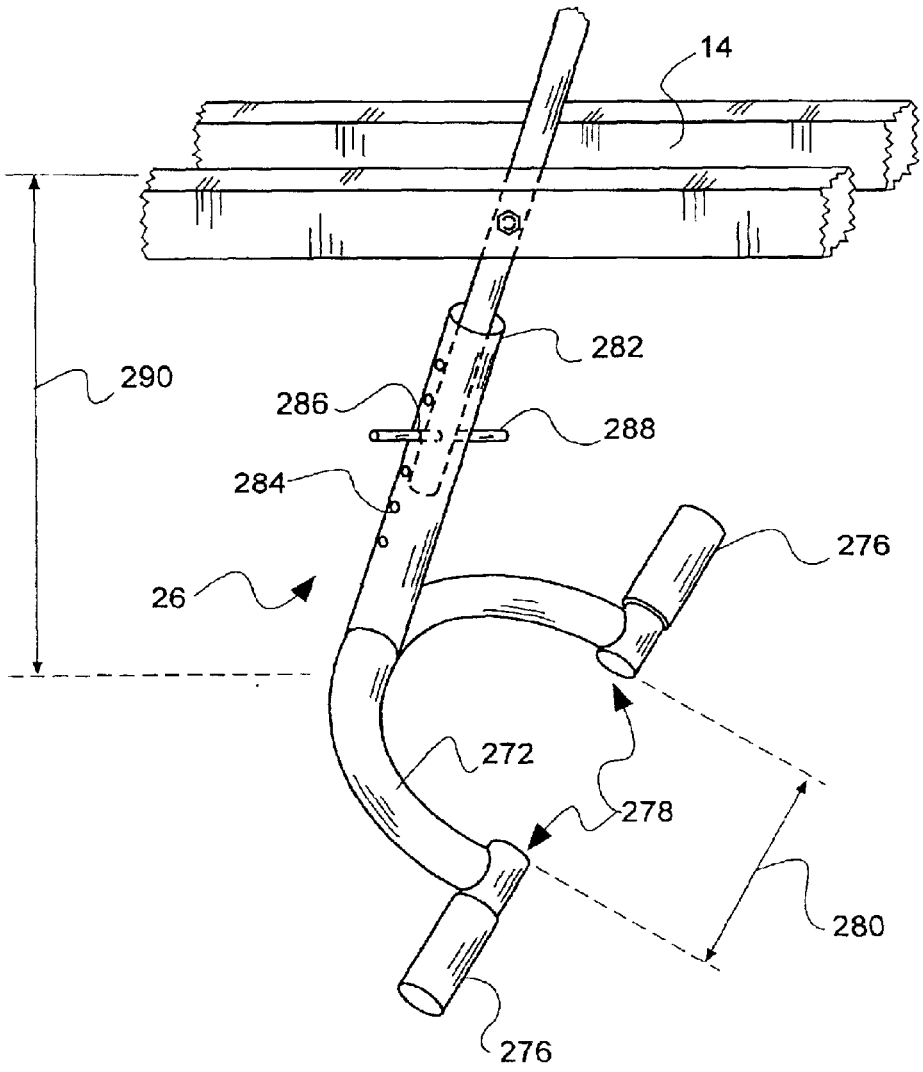
FIG. 15 illustrates a height adjustment mechanism for the foot grip assembly.

Referring to FIG. 15, the foot grip assembly 26 may be made adjustable, if desired, on the intermediate shaft portion 25. For example, the U-shaped member 272 may be secured to a tube-like sleeve member 282 having a series of connecting apertures 284. The lower end of the intermediate shaft portion 25 would have a corresponding aperture 286. A pin means 288 could then be removably inserted through one of the series of connecting apertures 284 and the corresponding aperture 286 to provide afoot grip assembly that is adjustable in length 290 below the pair of longitudinal rails 14. The length 290 below the longitudinal rails is preferably about eighteen (18) inches, but may be raised or lowered as desired by the user.

Figure 16:
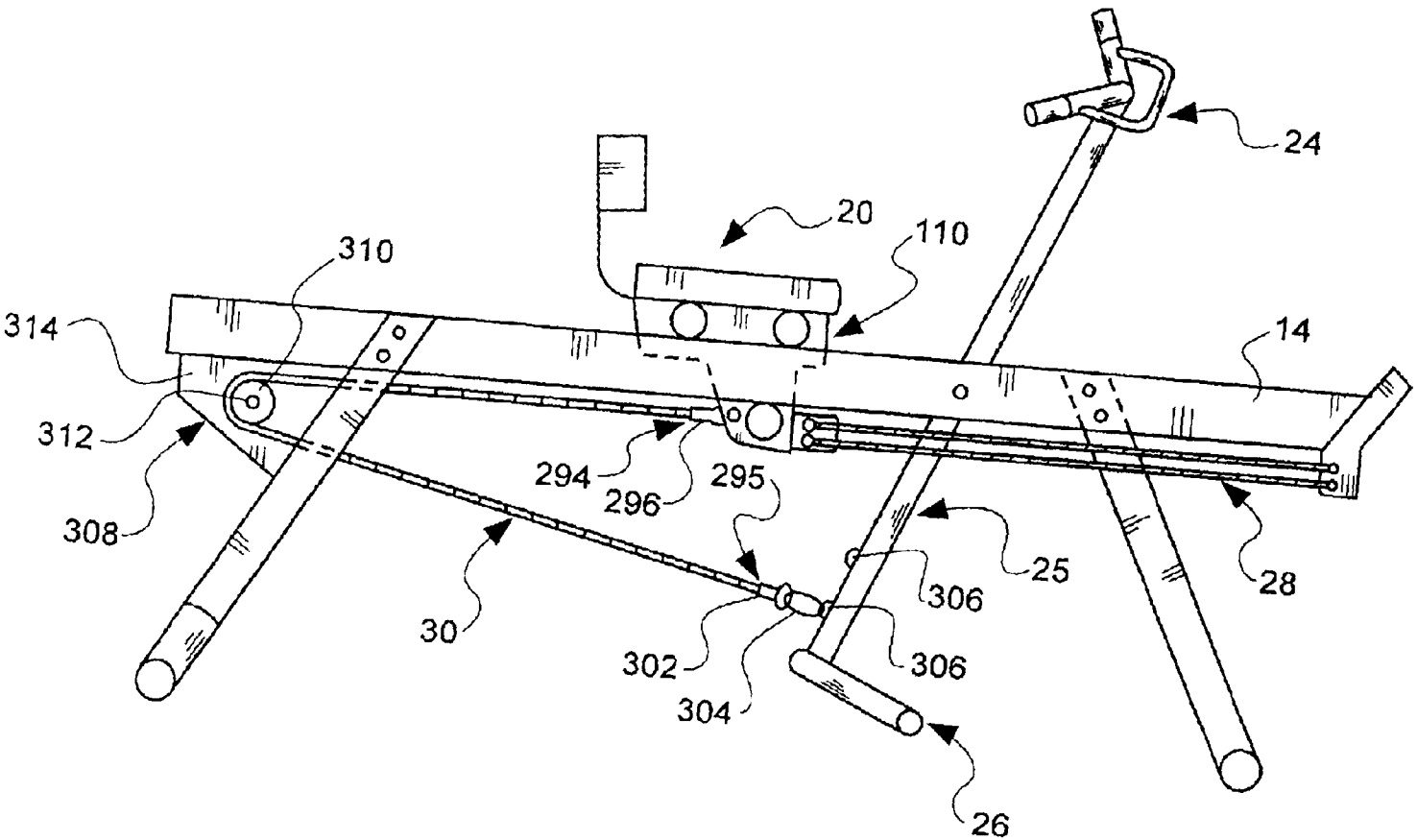
FIG. 16 is a side view of the exercise machine illustrated in FIG. 1 showing a preferred embodiment of the cable means and its associated connections.

Referring to FIG. 16, a cable means 30 is connected to the seat means 20 and to the foot grip assembly 26 and functions to transfer resistance from the resistance means 28—via the carriage means 19 or, for example, the roller and frame assembly 110—to the hand and foot lever assembly 22. The cable means 30 is preferably a steel cable 292 having a first end 294 that is connected to the below rail portion 134 of the roller and frame assembly 110 and a second end 295 that is connected to the hand and foot lever assembly 22 adjacent the foot grip assembly 26. The first end 294 has an eye member 296 that is secured to the first end 294 of the steel cable 292 using any suitable means, such as by crimping or soldering. The eye member 296 is itself connected to the roller and frame assembly 110 by inserting a pin or nut and bolt means 298 through a pair of apertures 300 that are positioned in the below rail portion 134 of the roller and frame assembly 110 and through the eye of the eye member 296. The second end 295 has an eye member 302 that is secured to the second end 295 of the steel cable 292 using any suitable means, such as by crimping or soldering. The eye member 302 is connected a hook means, such as hook 304, that is itself removably connected to one of a series of eyelets 306 that are welded to the lower end of the intermediate shaft portion 25 of the hand and foot lever assembly 22.

Figure 17:
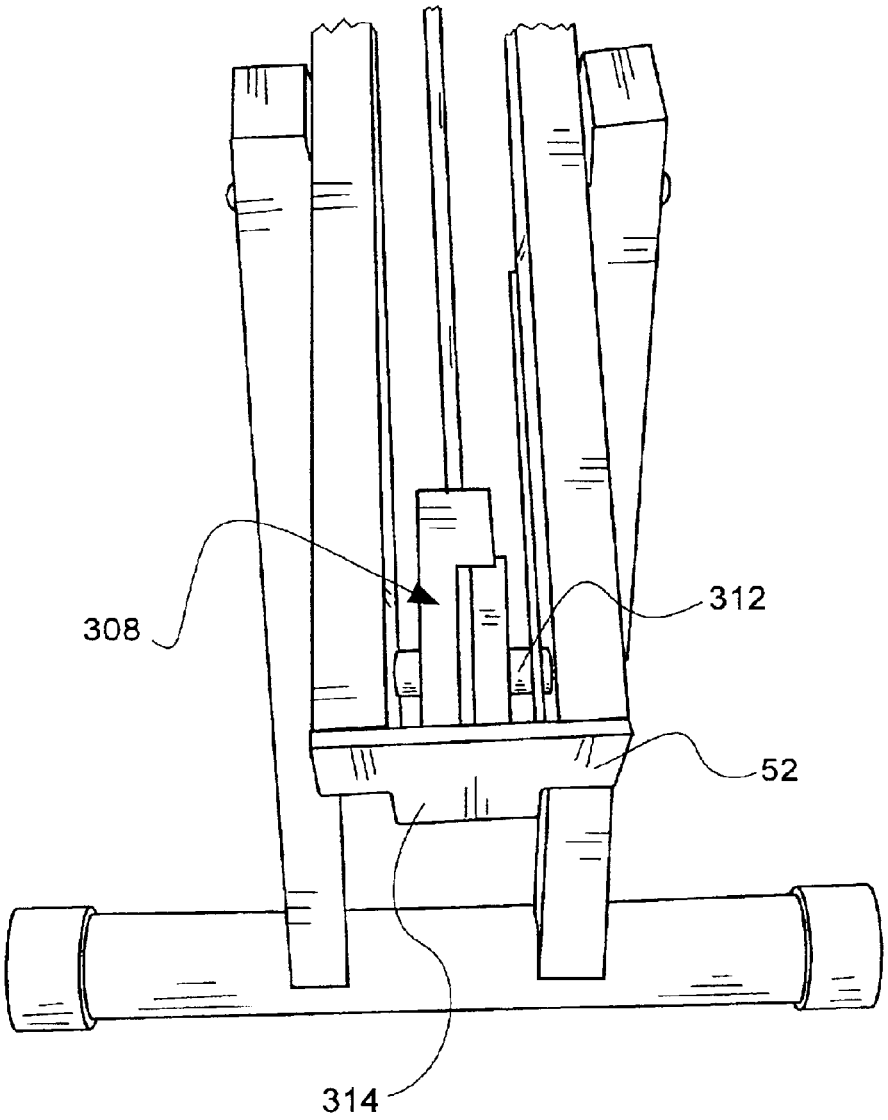
FIG. 17 is an overhead view of the aft-end of the exercise machine illustrated in FIG. 1.

Referring to FIGS. 16 and 17, a guide means 308, such as, for example, a pulley 310 mounted on a shaft means 312, functions to reverse directions of the cable means 30, such that the first end 294 of the cable means 30 is directed toward the roller and frame assembly 110 while the second end 295 of the cable means 30 is directed toward the series of eyelets 306 on the lower end of the intermediate shaft portion 25 of the hand and foot lever assembly 22. Preferably, the pulley 310 and the shaft means 312 are mounted to a plate structure 314 that is positioned on the aft end 34 of the pair of longitudinal rails 14.

Figure 19:
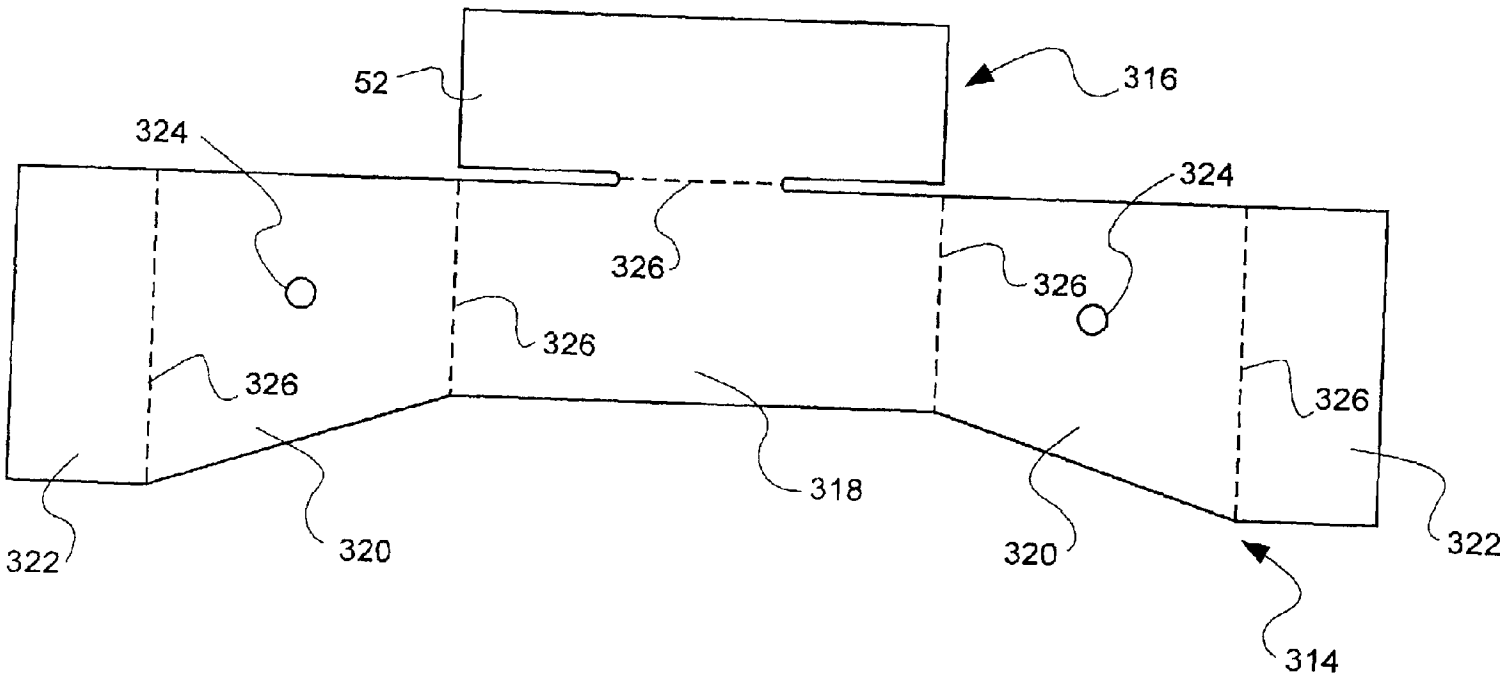
FIG. 19 is a plan view of a blank layout used in constructing the pulley-shaft engaging plates.

The plate structure 314 is preferably symmetric in layout and formed from a single blank of mild steel, having a thickness of about one-eighth (⅛) of an inch to about one-quarter (¼) of an inch, and preferably about one-eighth (⅛) of an inch. Illustrated in FIG. 19, for example, is a layout 316 for a single blank of mild steel from which the plate structure 314 is constructed. More particularly, the layout 316 illustrates the aft end-plate 52 connected to a lower aft end-plate 318. The lower aft end-plate 318 is connected on both its sides by a pair of pulley shaft engaging plates 320. The pulley shaft engaging plates 320 are themselves connected to respective support plates 322 that are ultimately connected by welded joint (not illustrated), for example, to the pair of support members 38 that form part of the aft support assembly 18. The layout 316 further illustrates a pair of apertures 324 that engage the ends of the shaft means 312. The bend lines (indicated by dotted lines 326) indicate where the plate structure 314 will be bent to form the various portions that are above described. Constructing the plate structure 314 in this fashion greatly increases its strength once assembled.

Figure 18:
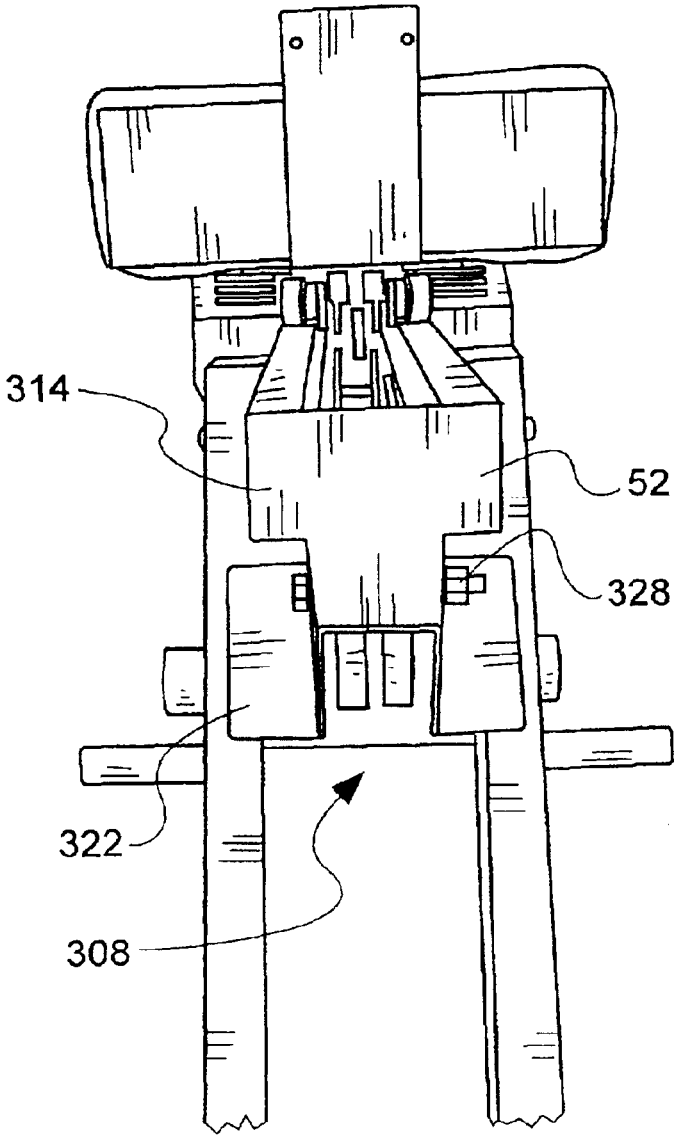
FIG. 18 is a rear-end view of the aft-end of the exercise machine illustrated in FIG. 1.

Referring to FIG. 18, the pulley 310 is preferably rotatably positioned between the pulley shaft engaging plates 320 by inserting the shaft means 312, such as nut and bolt 328, through the pair of apertures 324 and through a bearing assembly (not illustrated) that forms part of the pulley 310. The nut and bolt 328 is then secured in typical fashion. With the guide means 308 and the cable means 30 secured in the manner above described, the resistive force of the resistance means 28 is transferred to the hand and foot lever assembly 22 upon operation of the exercise machine.

Figure 20:
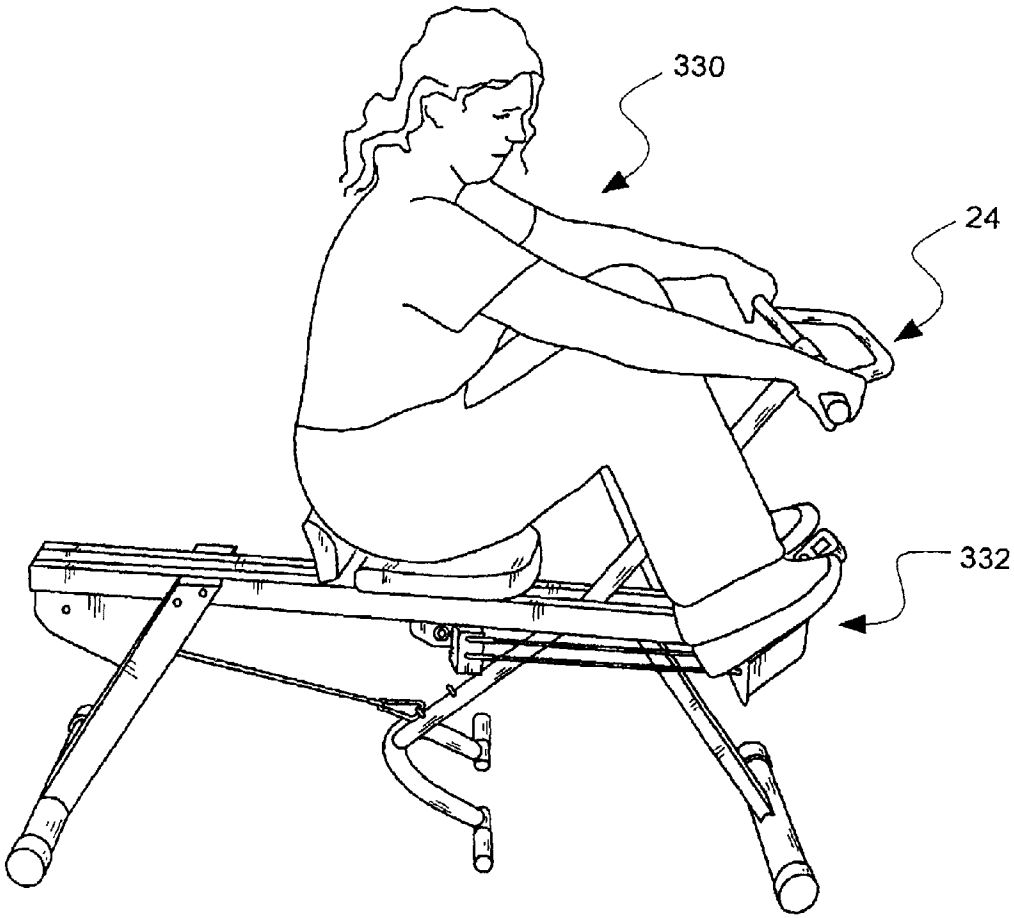
FIG. 20 is a perspective view of the exercise machine of the present invention being operated in a standard rowing-type exercise mode and where the operator is in the pre-stroke position.

Operation of the exercise machine is illustrated with reference to FIGS. 20–23. Specifically, FIG. 20 illustrates a user engaged in a rowing-type exercise in the pre-stroke position 330. The user's feet are positioned on the fore-end foot rests 332 and the user's hands grasp the hand grip assembly 24. The user then pulls on the hand grip assembly 24, which causes the hand and foot lever assembly 22 to rotate about the pivot point 246. When the hand and foot lever assembly 22 rotates about the pivot point 246 in this manner, the second end 295 of the cable means 30 is moved toward the fore-end of the exercise machine 10, together with the foot grip assembly 26. This causes the first end 294 of the cable means 30 to engage—via the connections on the carriage means 19—the resistance means 28. Thus, when the hand grip assembly 24 is pulled aft toward the user, the resistance means 28 provides a resistance to such movement. Furthermore, when the hand grip assembly 24 is pulled aft toward the user, the seat means is displaced toward the aft end of the exercise machine 10 by sliding on the longitudinal rails 14 as above described.

Figure 21:
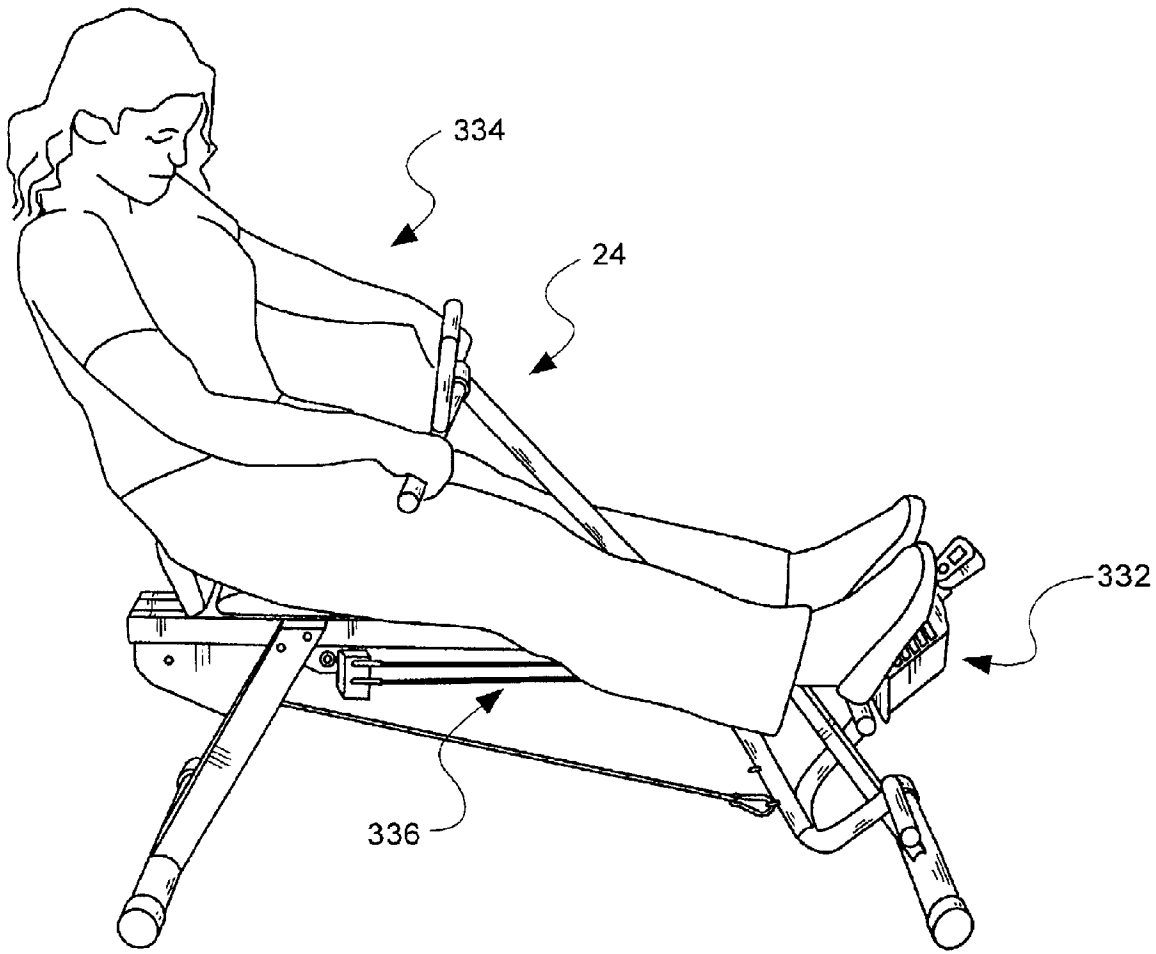
FIG. 21 is a perspective view of the exercise machine of the present invention being operated in a standard rowing-type exercise mode and where the operator is in the post-stroke position.

Referring to FIG. 21, a user in the post-stroke position 334 is illustrated. Here, the resistance means 28 is shown in a stretched state 336, as the first end 194 of the elastic cords 192 have undergone translation toward the aft end of the machine. At the same time, the seat means 20 has also translated toward the aft end of the exercise machine 10. Repeating the cycle between the pre-stroke position 330 and the post-stroke position 334 results in a rowing type exercise.

Figure 22:
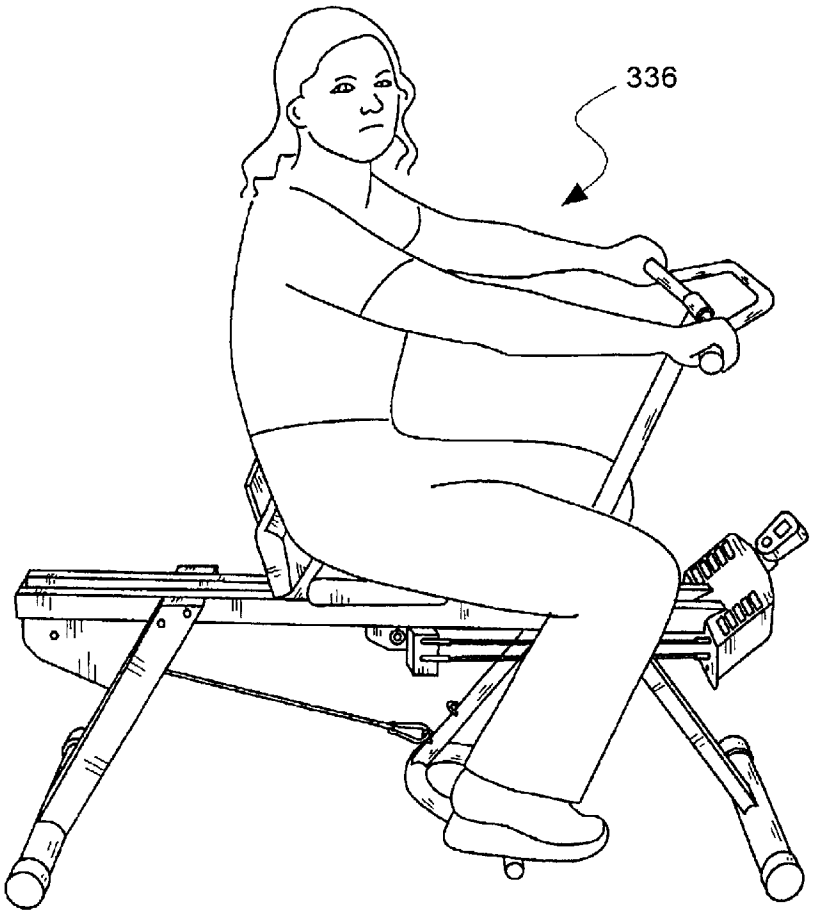
FIG. 22 is a perspective view of the exercise machine of the present invention being operated in a modified rowing-type exercise mode and where the operator is in the pre-stroke position.
Figure 23:
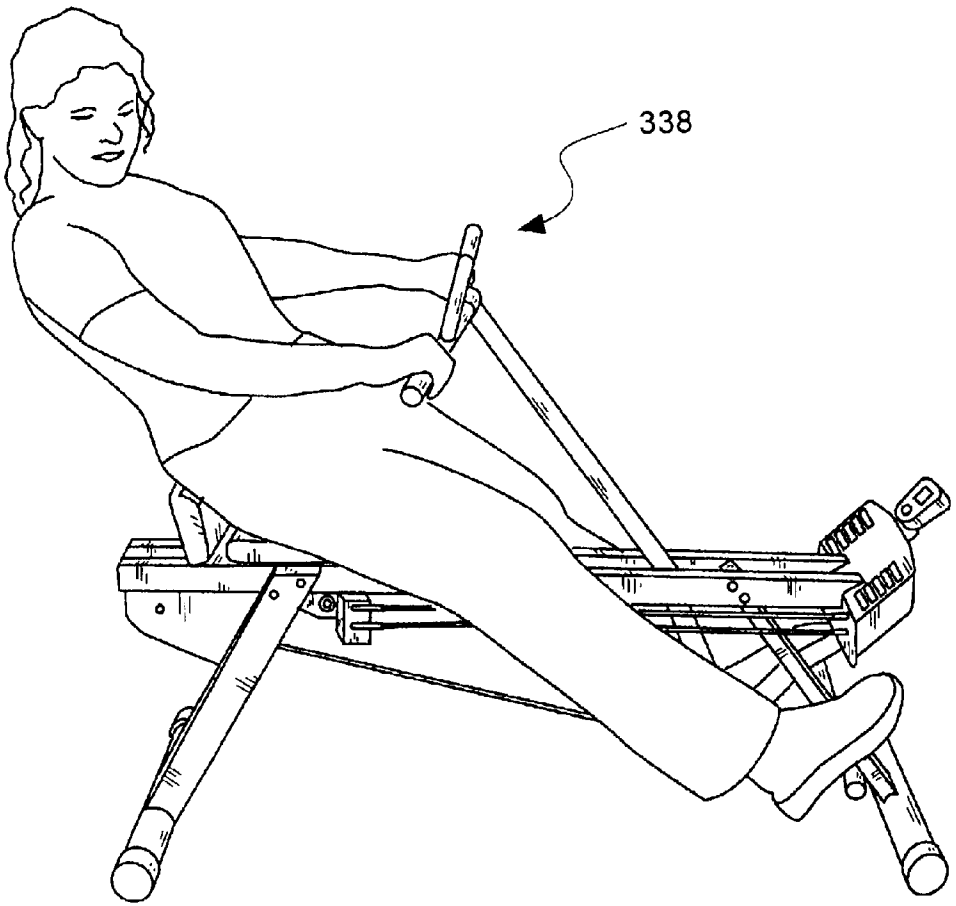
FIG. 23 is a perspective view of the exercise machine of the present invention being operated in a modified rowing-type exercise mode and where the operator is in the post-stroke position.

Referring now to FIGS. 22 and 23, a similar exercise is illustrated. Specifically, the user cycles between a pre-stroke position 336 and a post-stroke position 338. Here, the user's feet are positioned on the foot grip assembly 26 rather than the fore-end foot rests 332. With the feet so positioned on the foot grip assembly 26, the user experiences a similar rowing-type exercise, excepting that the feet traverse aft and fore along with the foot grip assembly 26 rather than remaining stationary on the fore-end foot rests 332. In either mode of using the exercise machine 10, the user can experience aerobic-type exercise from a full-body workout.

It is noted that a pair of elastic cables with hand grips (not illustrated) may, optionally, be secured to the second bracket means 226. The pair of elastic cables so positioned would give the user the option of performing an additional exercise, whereby the user sits on the seat means 20, places his or her feet against the fore-end foot rests 332 and pulls on the hand grips connected to the cables. When the cables are pulled, the user can also extend his or her legs, thereby forcing the seat means 20 toward the aft end of the exercise machine 10. In so doing, the resistance provided by the resistance means 28 would also be realized by the user when he or she pushes against the fore-end foot rests 332, thereby forcing the seat means 20, together with the carriage means 19, toward the aft end of the exercise machine 10. Thus, a third type of exercise can, optionally, be performed with the exercise machine 10, excepting that this type of exercise would not require use of the hand and foot lever assembly 22.

With respect to the above description of the invention and operation thereof, it is to be realized that the optimum dimensional relationships for the components of the invention, including variations in size, materials, shape, form, function and manner of operation, assembly and use, may be readily apparent and obvious to one skilled in the art and, therefore, all equivalent relationships to those illustrated in the drawings and described in the specification are intended to be encompassed by the present invention. In other words, the foregoing is considered as illustrative only of the principals of the invention. Further, since numerous modifications and changes may readily occur to those skilled in the art, the foregoing should not be construed to limit the invention to the exact construction and operation shown and described, all suitable modifications and equivalents therefore falling within the scope of the invention as set forth in the following append claims.

What is claimed:

1. An exercise machine, comprising:

rail means for supporting a carriage means together with the weight of a user, said rail means having a first end and a second end spaced from said first end;

support means for supporting said rail means above a support surface, said support means having a first end connected to said rail means and a second end configured for contact with said support surface;

carriage means for slidably supporting the weight of a user on said rail means, said carriage means having sliding means for sliding engagement with said rail means, said carriage means having a first connection means and a second connection means;

lever means for operating said exercise machine by said user, said lever means being pivotally connected to said rail means, said lever means having a first end and a second end spaced from said first end;

resistance means for providing resistance to pivotal movement of said lever means, said resistance means having a first end connected to said first connection means and a second end connected to said rail means;

cable means for operably connecting said lever means to said resistance means, said cable means having a first end connected to said second connection means and a second end connected to said second end of said lever means;

guide means for guiding said first end of said cable means toward said second connection means and for guiding said second end of said cable means toward said second end of said lever means, said guide means being connected to said rail means proximate said second end of said rail means; and seat means for positioning the buttocks of a user thereon, said seat means being connected to said carriage means.

2. The exercise machine of claim 1, wherein said rail means includes a first longitudinal rail and a second longitudinal rail, said first longitudinal rail and said second longitudinal rail being disposed in a side by side fashion, said first longitudinal rail having an upper surface and a lower surface, said second longitudinal rail having an upper surface and a lower surface.

3. The exercise machine of claim 2, wherein said lever means comprises an elongate member having a first end and a second end spaced from said first end, said elongate member having an intermediate portion pivotally disposed between said first longitudinal rail and said second longitudinal rail.

4. The exercise machine of claim 1, wherein said carriage means includes a frame member and wherein said sliding means includes at least one roller wheel mounted to said frame member and in rolling contact with said rail means.

5. The exercise machine of claim 1, wherein said resistance means includes at least one elastic cord.

6. The exercise machine of claim 1, wherein said resistance means includes at least one gas cylinder.

7. The exercise machine of claim 1, wherein said guide means includes a pulley, and wherein said pulley is rotatably mounted to said rail means proximate said second end of said rail means.

8. The exercise machine of claim 1, wherein said rail means includes at least one longitudinal rail, said at least one longitudinal rail having a first end, a second end and a central portion intermediate said first end and said second end.

9. The exercise machine of claim 8, wherein said central portion of said at least one longitudinal rail has an aperture extending there through and wherein said lever means includes an elongate member having a first end and a second end spaced from said first end, said elongate member having an intermediate portion extending through said aperture and pivotally connected to said longitudinal rail.

10. The exercise machine of claim 8, wherein said central portion of said at least one longitudinal rail has a first side wall and a second side wall and wherein said lever means includes an upper portion, a lower portion and an intermediate portion and wherein said intermediate portion is pivotally connected to at least one of said first side wall and said second side wall.

11. The exercise machine of claim 8, wherein said at least one longitudinal rail has a length and a sidewall extending along a portion of said length, wherein said sidewall has a channel recessed therein, wherein said carriage means includes a frame and wherein said frame includes at least one tab member configured for sliding engagement with said channel.

12. The exercise machine of claim 2, wherein said carriage means includes a roller and frame assembly slidably engaged with both said first longitudinal rail and said second longitudinal rail, said roller and frame assembly having a first wheel in rolling contact with said upper surface of said first longitudinal rail and a second wheel in rolling contact with said upper surface of said second longitudinal rail, said roller and frame assembly having a third wheel in rolling contact with said upper surface of said first longitudinal rail and a fourth wheel in rolling contact with said upper surface of said second longitudinal rail, said roller and frame assembly having a fifth wheel in rolling contact with said lower surface of said first longitudinal rail and a sixth wheel in rolling contact with said lower surface of said second longitudinal rail.

13. The exercise machine of claim 12, further including a hand grip, said hand grip being connected to said lever means proximate said first end of said lever means.

14. The exercise machine of claim 12, further including a foot grip, said foot grip being connected to said lever means proximate said second end of said lever means.

15. An exercise machine, comprising:

at least one longitudinal rail, said at least one longitudinal rail having a first end and a second end spaced from said first end;

a support structure connected to said at least one longitudinal rail;

a lever structure pivotally connected to said at least one longitudinal rail;

a carriage structure slidably engaged with said at least one longitudinal rail;

resistance means for providing resistance to movement of said carriage structure along said at least one longitudinal rail, said resistance means having a first end connected to said longitudinal rail and a second end connected to said carriage structure;

a cable, said cable having a first end connected to said carriage structure and a second end connected to said lever structure; and a pulley, said pulley being rotatably connected to said at least one longitudinal rail proximate said second end of said at least one longitudinal rail, said cable being operably coupled to said pulley.

16. An exercise machine, comprising:

a frame, said frame having a first end, a second end and a longitudinal portion intermediate said first end and said second end, said frame being configured for positioning on a support surface;

a lever structure pivotally connected to said longitudinal portion of said frame, said lever structure having an upper end and a lower end, said lever structure including foot supports positioned proximate said lower end and sized and configured for placement of the feet of the user, said lever structure further including hand grips positioned proximate said upper end and sized and configured for receiving the hands of a user;

a carriage structure slidably engaged with said longitudinal portion of said frame;

resistance means for providing resistance to movement of said carriage structure along said longitudinal portion of said frame;

a cable, said cable having a first end connected to said carriage structure and a second end connected to said lever structure; and a pulley, said pulley being rotatably connected to said longitudinal portion of said frame proximate said second end of said longitudinal portion of said frame, said cable being operably coupled to said pulley.

17. The exercise machine of claim 16, wherein said longitudinal portion of said frame includes a single longitudinal rail.

18. The exercise machine of claim 16, wherein said longitudinal portion of said frame includes a plurality of longitudinal rails.

19. The exercise machine of claim 16, wherein said carriage structure includes a roller wheel.

20. The exercise machine of claim 16, wherein said longitudinal portion of said frame is disposed at a non-zero angle relative to said support surface.

* * * * *